US009269549B2

(12) United States Patent
Green et al.

(10) Patent No.: US 9,269,549 B2
(45) **Date of Patent: *Feb. 23, 2016**

(54) MASS SPECTROMETER DEVICE AND METHOD USING SCANNED PHASE APPLIED POTENTIALS IN ION GUIDANCE

(71) Applicant: Micromass UK Limited, Manchester (GB)

(72) Inventors: Martin Raymond Green, Bowdon (GB); Jason Lee Wildgoose, Stockport (GB); Steven Derek Pringle, Darwen (GB); Daniel James Kenny, Knutsford (GB)

(73) Assignee: Micromass UK Limited, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/081,201

(22) Filed: Nov. 15, 2013

(65) Prior Publication Data

US 2014/0138534 A1 May 22, 2014

Related U.S. Application Data

(63) Continuation of application No. 13/908,568, filed on Jun. 3, 2013, now Pat. No. 8,586,917, which is a continuation of application No. 13/078,198, filed on Apr. 1, 2011, now Pat. No. 8,455,819, which is a (Continued)

(30) Foreign Application Priority Data

Apr. 28, 2006 (GB) ..... 0608470.1

(51) Int. Cl.

*H01J 49/36* (2006.01)
*H01J 49/40* (2006.01)
*H01J 49/00* (2006.01)
*H01J 49/06* (2006.01)

(Continued)

(52) U.S. Cl.

CPC ..... *H01J 49/0031* (2013.01); *H01J 49/022* (2013.01); *H01J 49/062* (2013.01); *H01J 49/065* (2013.01); *H01J 49/36* (2013.01); *H01J 49/4235* (2013.01); *Y10T 436/24* (2015.01)

(58) Field of Classification Search

USPC ..... 250/281, 282, 291, 292; 702/30, 181

See application file for complete search history.

(56) References Cited

U.S. PATENT DOCUMENTS 4,540,884 A * 9/1985 Stafford et al. ..... 250/282
4,982,088 A * 1/1991 Weitekamp et al. ..... 250/291
5,179,278 A * 1/1993 Douglas ..... 250/290

(Continued)

FOREIGN PATENT DOCUMENTS

JP 2002184347 6/2002

*Primary Examiner* — David A Vanore

(74) *Attorney, Agent, or Firm* — Diederiks & Whitelaw, PLC

(57) ABSTRACT

An ion guide or mass analyzer is disclosed comprising a plurality of electrodes having apertures through which ions are transmitted in use. A pseudo-potential barrier is created at the exit of the ion guide or mass analyzer. The amplitude or depth of the pseudo-potential barrier is inversely proportional to the mass to charge ratio of an ion. One or more transient DC voltages are applied to the electrodes of the ion guide or mass analyzer in order to urge ions along the length of the ion guides or mass analyzer. The amplitude of the transient DC voltage applied to the electrode may be increased with time so that ions are caused to be emitted from the ion guide or mass analyzer in reverse order of their mass to charge ratio.

19 Claims, 17 Drawing Sheets

Related U.S. Application Data continuation of application No. 12/297,481, filed as application No. PCT/GB2007/001589 on Apr. 30, 2007, now Pat. No. 7,919,747.

(60) Provisional application No. 60/801,772, filed on May 19, 2006.

(51) Int. Cl.
*H01J 49/42* (2006.01)
*H01J 49/02* (2006.01)

(56) References Cited

U.S. PATENT DOCUMENTS 5,206,506 A 4/1993 Kirchner
5,420,425 A * 5/1995 Bier et al. ..... 250/292
5,420,549 A * 5/1995 Prestage ..... 331/94.1
5,517,025 A * 5/1996 Wells et al. ..... 250/282
6,111,250 A 8/2000 Thomson et al.
6,177,668 B1 * 1/2001 Hager ..... 250/282
6,483,109 B1 11/2002 Reinhold et al.
6,674,071 B2 * 1/2004 Franzen et al. ..... 250/292
6,838,662 B2 1/2005 Bateman et al.
6,903,331 B2 * 6/2005 Bateman et al. ..... 250/287
6,914,241 B2 * 7/2005 Giles et al. ..... 250/286
6,960,760 B2 * 11/2005 Bateman et al. ..... 250/286
6,987,261 B2 * 1/2006 Horning et al. ..... 250/282
7,034,293 B2 * 4/2006 Wells ..... 250/292
7,071,464 B2 * 7/2006 Reinhold ..... 250/282
7,145,139 B2 12/2006 Syka
7,157,698 B2 1/2007 Makarov et al.
7,227,134 B2 * 6/2007 Miller et al. ..... 250/288
7,228,239 B1 * 6/2007 Cetto ..... 702/30
7,230,237 B2 6/2007 Ueno
7,359,805 B1 * 4/2008 Cetto ..... 702/30
7,365,319 B2 4/2008 Hager
7,378,653 B2 * 5/2008 Wells ..... 250/292
7,403,867 B2 * 7/2008 LeGore et al. ..... 702/181
7,456,388 B2 11/2008 Loboda et al.
7,495,211 B2 * 2/2009 Franzen et al. ..... 250/291
7,557,344 B2 * 7/2009 Chernushevich et al. .... 250/292
7,586,088 B2 * 9/2009 Bateman et al. ..... 250/281
7,589,321 B2 * 9/2009 Hashimoto et al. ..... 250/292
7,601,952 B2 * 10/2009 Hager et al. ..... 250/292
7,622,711 B2 * 11/2009 Wildgoose et al. ..... 250/283
7,820,961 B2 * 10/2010 Hashimoto et al. ..... 250/281
7,829,841 B2 * 11/2010 Bateman et al. ..... 250/281
7,919,747 B2 * 4/2011 Green et al. ..... 250/282
7,960,694 B2 * 6/2011 Hoyes ..... 250/292
8,022,358 B2 9/2011 Green
8,049,169 B2 11/2011 Satake et al.
8,076,637 B2 * 12/2011 Pringle et al. ..... 250/282
8,212,208 B2 7/2012 Green et al.
8,389,933 B2 3/2013 Hoyes
8,455,819 B2 * 6/2013 Green et al. ..... 250/292
8,586,917 B2 * 11/2013 Green et al. ..... 250/291
2004/0051038 A1 3/2004 Taniguchi
2004/0222369 A1 * 11/2004 Makarov et al. ..... 250/281
2004/0245455 A1 * 12/2004 Reinhold ..... 250/288
2008/0302958 A1 * 12/2008 Green ..... 250/282
2009/0014637 A1 * 1/2009 Giles et al. ..... 250/281
2009/0072136 A1 * 3/2009 Pringle et al. ..... 250/290
2009/0134321 A1 * 5/2009 Hoyes ..... 250/282
2010/0038530 A1 * 2/2010 Giles et al. ..... 250/283
2010/0084552 A1 * 4/2010 Kawana ..... 250/288
2010/0294923 A1 11/2010 Kenny et al.
2011/0049358 A1 * 3/2011 Green et al. ..... 250/283
2011/0180704 A1 * 7/2011 Green et al. ..... 250/282
2012/0091334 A1 * 4/2012 Guna ..... 250/283

* cited by examiner

MASS SPECTROMETER DEVICE AND METHOD USING SCANNED PHASE APPLIED POTENTIALS IN ION GUIDANCE

CROSS-REFERENCE TO RELATED APPLICATION

This application is a continuation of U.S. patent application Ser. No. 13/908,568 filed on Jun. 3, 2012 which is a continuation of U.S. patent application Ser. No. 13/078,198 filed on Apr. 1, 2011 which is a continuation of U.S. patent Ser. No. 12/297,481 filed on Jan. 23, 2009 which represents a National Stage of International Application No. PCT/GB2007/001589 filed on Apr. 30, 2007 and claims the benefit of U.S. Provisional Patent Application Ser. No. 60/801,772 filed on May 19, 2006. The entire contents of these applications are incorporated by reference.

BACKGROUND OF THE INVENTION

The present invention relates to a mass spectrometer and a method of mass spectrometry.

It is a common requirement in a mass spectrometer for ions to be transferred through a region maintained at an intermediate pressure i.e. at a pressure wherein collisions between ions and gas molecules are likely to occur as ions transit through an ion guide. Ions may need to be transported, for example, from an ionisation region which is maintained at a relatively high pressure to a mass analyser which is maintained at a relatively low pressure. It is known to use a radio frequency (RF) transport ion guide operating at an intermediate pressure of around $10^{-3}$-$10^{1}$ mbar to transport ions through a region maintained at an intermediate pressure. It is also well known that the time averaged force on a charged particle or ion due to an AC inhomogeneous electric field is such as to accelerate the charged particle or ion to a region where the electric field is weaker. A minimum in the electric field is commonly referred to as a pseudo-potential well or valley. RF ion guides are designed to exploit this phenomenon by causing a pseudo-potential well to be formed, along the central axis of the ion guide so that ions are confined radially within the ion guide.

It is known to use an RF ion guide to confine ions radially and to subject the ions to Collision Induced Dissociation or fragmentation within the ion guide. Fragmentation of ions is typically carried out at pressures in the range $10^{-3}$-$10^{-1}$ mbar either within an RF ion guide or within a dedicated gas collision cell.

It is also known to use an RF ion guide to confine ions radially within an ion mobility separator or spectrometer. Ion mobility separation may be carried out at atmospheric pressure or at pressures in the range $10^{-1}$-$10^{1}$ mbar.

Different forms of RF ion guide are known including a multi-pole rod set ion guide and a ring stack or ion tunnel ion guide. A ring stack or ion tunnel ion guide comprises a stacked ring electrode set wherein opposite phases of an RF voltage are applied to adjacent electrodes. A pseudo-potential well is formed along the central axis of the ion guide so that ions are confined radially within the ion guide. The ion guide has a relatively high transmission efficiency.

An RF ion guide is disclosed in US 2005/0253064 wherein an RF voltage is applied to an elongated rod set in order to confine ions radially within the ion guide. A static axial, electric field is arranged to propel ions along the axis of the ion guide. An RF axial electric field is also arranged at the exit of the ion guide. The RF axial electric field generates an axial pseudo-potential barrier which acts as a barrier to ions. The magnitude of the pseudo-potential barrier is inversely dependent upon the mass to charge ratio of the ions. Therefore, ions having a relatively low mass to charge ratio will experience a pseudo-potential barrier which has a relatively large amplitude. The pseudo-potential barrier counter-acts the effect of the static axial field for ions having relatively low mass to charge ratios but does not counteract the effect of the static axial field upon ions having relatively high mass to charge ratios. Accordingly, ions having relatively high mass to charge ratios are ejected from the ion guide. Ions may be manipulated within the ion guide or may be mass selectively ejected by adjusting the amplitude of the static or oscillating electric fields.

The known ion guide, has a well-defined radial stability condition for ions having a particular mass to charge ratio. This is determined by the approximately quadratic nature of the radial potential which is maintained. Therefore, disadvantageously, if the oscillating electric field along the axis of the ion guide is changed in any way then this may cause undesired radial instabilities and/or resonance effects which may result in ions being lost to the system.

It is therefore desired to provide an improved ion guide or mass analyser.

SUMMARY OF THE INVENTION

According to an aspect of the present invention there is provided a mass analyser comprising:

an ion guide comprising a plurality of electrodes;

means for applying a first AC or RF voltage to at least some of the plurality of electrodes such that, in use, a plurality of first axial time averaged or pseudo-potential barriers, corrugations or wells having a first amplitude are created along at least a portion of the axial length of the ion guide; and means for driving or urging ions along at least a portion of the axial length of the ion guide;

the mass analyser further comprising:

means for applying a second AC or RF voltage to one or more of the plurality of electrodes such that, in use, one or more second axial time averaged or pseudo-potential barriers, corrugations or wells having a second amplitude are created along at least a portion of the axial length of the ion guide, wherein the second amplitude is different from the first amplitude.

In a mode of operation ions having mass to charge ratios ≥M1 preferably exit the ion guide whilst, ions having mass to charge ratios <M2 are preferably axially trapped or confined within the ion guide by the one or more second axial time averaged or pseudo-potential barriers, corrugations or wells. Preferably, M1 falls with a first range which is preferably selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; and (xi) >1000. Preferably, M2 falls with a second range which is preferably selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; and (xi) >1000. According to an embodiment M1 and M2 may have the same value.

In a mode of operation ions are preferably sequentially ejected from the mass analyser in order of their mass to charge ratio or in reverse order of their mass to charge ratio.

According to the preferred embodiment the ion guide comprises n axial segments, wherein n is selected from the group consisting of: (i) 1-10; (ii) 11-20; (iii) 21-30; (iv) 31-40; (v) 41-50; (vi) 51-60; (vii) 61-70; (viii) 71-80; (ix) 81-90; (x) 91-100; and (xi) >100. Each axial segment preferably comprises 1, 2, 3, 4, 5, 6, 7, 8, 9, 10, 11, 12, 13, 14, 15, 16, 17, 18, 19, 20 or >20 electrodes. The axial length of at least 1%, 5%, 10%, 20%, 30%, 40%, 50%, 60%, 70%, 80%, 90%, 95% or 0.100% of the axial segments is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm. The spacing between at least 1%, 5%, 10%, 20%, 30%, 40%, 50%, 60%, 70%, 80%, 90%, 95% or 100% of the axial segments is preferably selected from the group consisting of; (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The ion guide preferably has a length selected from the group consisting of; (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm.

The ion guide preferably comprises at least: (i) 10-20 electrodes; (ii) 20-30 electrodes; (iii) 30-40 electrodes; (iv) 40-50 electrodes; (v) 50-60 electrodes; (vi) 60-70 electrodes; (vii) 70-80 electrodes; (viii) 80-90 electrodes; (ix) 90-100 electrodes; (x) 100-110 electrodes; (xi) 110-120 electrodes; (xii) 120-130 electrodes; (xiii) 130-140 electrodes; (xiv) 140-150 electrodes; or (xv) >150 electrodes.

According to the preferred embodiment the plurality of electrodes preferably comprises electrodes having apertures through which ions; are transmitted in use. At least 1%, 5%, 10%, 20%, 30%, 40%, 50%, 60%, 70%, 80%, 90%, 95% or 100% of the electrodes preferably have substantially circular, rectangular, square or elliptical apertures.

According to an embodiment at least 1%, 5%, 1.0%, 20%, 30%, 40%, 50%, 60%, 70%, 80%, 90%, 95% or 100% of the electrodes have apertures which are substantially the same size or which have substantially the same area. According to another embodiment at least 1%, 5%, 10%, 20%, 30%, 40%, 50%, 60%, 70%, 80%, 90%, 0.95% or 100% of the electrodes have apertures which become progressively larger and/or smaller in size or in area in a direction along the axis of the ion guide.

According to the preferred embodiment at least 1%, 5%, 10%, 20%, 30%, 40%, 50%, 60%, 70%, 80%, 90%, 95% or 100% of the electrodes preferably have apertures having internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

At least 1%, 5%, 10%, 20%, 30%, 40%, 50%, 60%, 70%, 80%, 0.90%, 95% or 100% of the electrodes are preferably spaced apart from one another by an axial distance selected, from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 ism; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 vim; and (xv) less than or equal to 0.25 mm.

At least some of the plurality of electrodes preferably comprise apertures and wherein the ratio of the internal diameter or dimension of the apertures to the centre-to-centre axial spacing between adjacent electrodes is selected from the group consisting of: (i) <1.0; (ii) 1.0-1.2; (iii) 1.2-1.4; (iv) 1.4-1.6; (v) 1.6-1.8; (vi) 1.8-2.0; (vii) 2.0-2.2; (viii) 2.2-2.4; (ix) 2.4-2.6; (x) 2.6-2.8; (xi) 2.8-3.0; (xii) 3.0-3.2; (xiii) 3.2-3.4; (xiv) 3.4-3.6; (xv) 3.6-3.8; (xvi) 3.8-4.0; (xvii) 4.0-4.2; (xviii) 4.2-4.4; (xix) 4.4-4.6; (xx) 4.6-4.8; (xxi) 4.8-5.0; and (xxii) >5.0.

At least 1%, 5%, 10%, 20%, 30%, 40%, 50%, 60%, 70%, 80%, 90%, 95% or 100% of the electrodes preferably have a thickness or axial length selected from the group consisting of: (i) less than or equal to 5 mitt; (ii) less than or equal to 4.5 mm; (iii) less than or equal to 4 mm; (iv) less than or equal to 3.5 ran; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm.

According to another embodiment the ion guide may comprise a segmented rod set ion guide. The ion guide may comprise, for example, a segmented quadrupole, hexapole or octapole ion guide or ion guide comprising more than eight segmented rod sets. The ion guide preferably comprises a plurality of electrodes having a cross-section selected from the group consisting of: (i) approximately or substantially circular cross-section; (ii) approximately or substantially hyperbolic surface; (iii) an arcuate or part-circular cross-section; (iv) an approximately or substantially rectangular cross-section; and (v) an approximately or substantially square cross-section.

According to an alternative embodiment the ion guide may comprise a plurality of plate electrodes, wherein a plurality of groups of plate electrodes are arranged along the axial length of the ion guide. Each group of plate electrodes preferably comprises a first plate electrode and a second plate electrode. The first and second plate electrodes are preferably arranged substantially in the same plane and are preferably arranged either side of the central longitudinal axis of the ion guide. The mass analyser preferably further comprises means for applying a DC voltage or potential to the first and second plate electrodes in order to confine ions in a first radial direction within the ion guide.

Each group of electrodes preferably further comprises a third plate electrode and a fourth plate electrode. The third and fourth plate electrodes are preferably arranged substantially in the same plane and are preferably arranged either side of the central longitudinal axis of the ion guide in a different orientation to the first and second plate electrodes. The means for applying an AC or RF voltage is preferably arranged to apply an AC or RF voltage to the third and fourth plate electrodes in order to confine ions in a second radial direction within the ion guide. The second radial direction is preferably orthogonal to the first radial direction.

The means for driving or urging ions preferably comprises means for applying one more transient DC voltages or potentials or one or more DC voltage or potential waveforms to at least 1%, 5%, 10%, 20%, 30%, 40%, 50%, 60%, 70%, 80%, 90%, 95% or 100% of the electrodes. The one or more transient DC voltages or potentials or the one or more DC voltage or potential waveforms preferably create; (i) a potential hill or barrier; (ii) a potential, well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage or potential waveforms preferably comprise a repeating waveform or square wave.

According to the preferred embodiment a plurality of axial DC potential wells are preferably translated along the length of the ion guide or a plurality of transient DC potentials or voltages are progressively applied to electrodes along the axial length of the ion guide.

According to an embodiment the mass analyser preferably further comprises first means arranged and adapted to progressively increase, progressively decrease, progressively vary, scan, linearly increase, linearly decrease, increase in a stepped, progressive or other manner or decrease in a stepped, progressive or other manner the amplitude, height or depth of the one or more transient DC voltages or potentials or the one or more DC voltage or potential waveforms.

The first means is preferably arranged and adapted to progressively increase, progressively decrease, progressively vary, scan, linearly increase, linearly decrease, increase in a stepped, progressive or other manner or decrease in a stepped, progressive or other manner the amplitude, height, or depth of the one or more transient DC voltages or potentials or the one or more DC voltage or potential waveforms by $x_1$ Volts over a time period $t_1$. Preferably, $x_1$ is selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V. Preferably, $t_1$, is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 as; (xxx) 1-2 s; (xxii) 2-3 s; (xxiii) 3-4 s; (xxiv) 4-5 s; and (xxv) >5 s.

The mass analyser preferably comprises second means arranged and adapted to progressively increase, progressively decrease, progressively vary, scan, linearly increase, linearly decrease, increase in a stepped, progressive or other manner or decrease in a stepped, progressive or other manner the velocity or rate at which the one or more, transient DC voltages or potentials or the one or more DC potential or voltage waveforms are applied to the electrodes. The second means is preferably arranged and adapted to progressively increase, progressively decrease, progressively vary, scan, linearly increase, linearly decrease, increase in a stepped, progressive or other manner or decrease in a stepped, progressive or other manner the velocity or rate at which the one or more transient DC voltages or potentials or the one or more DC voltage, or potential waveforms are applied to the electrodes by $x_2$ m/s over a time period $t_2$. Preferably, $x_2$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-11; (xii) 11-12; (xiii) 12-13; (xiv) 13-14; (xv) 14-15; (xvi) 15-16; (xvii) 16-17; (xviii) 17-18; (xix) 18-19; (xx) 19-20; (xxi) 20-30; (xxii) 30-40; (xxiii) 40-50; (xxiv) 50-60; (xxv) 60-70; (xxvi) 70-80; (xxvii) 80-90; (xxviii) 90-100; (xxix) 100-150; (xxx) 150-200; (xxxi) 200-250; (xxxii) 250-300; (xxxiii) 300-350; (xxxiv) 350-400; (xxxv) 400-450; (xxxvi) 450-500; and (xxxvii) >500. Preferably, $t_2$ is selected from the group consisting of; (i) <1 ms; (ii) 1-1.0 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xxx) 800-900 ms; (xx) 900-1000 ms; (xxi) 1-2 s; (xxii) 2-3 s; (xxiii) 3-4 s; (xxiv) 4-5 s; and (xxv) >5 s.

According to the preferred embodiment the first AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak.

According to the preferred embodiment the first AC or RF voltage preferably has a frequency selected from the group consisting of: (i) <100 kHz; (ii) 100-200 kHz; (iii) 200-300 kite; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The means for applying the first AC or RF voltage is preferably arranged to apply the first AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the plurality of electrodes.

The means for applying the first AC or RF voltage is preferably arranged to supply axially adjacent, electrodes or axially adjacent groups of electrodes with opposite phases of the first AC or RF voltage.

The first axial time averaged or pseudo-potential barriers, corrugations or wells are preferably created, in use, along at least 1%, 5%, 10%, 20%, 30%, 40%, 50%, 60%, 70%, 80%, 90% or 95% of the axial length of the ion guide.

The plurality of first axial time averaged or pseudo-potential barriers, corrugations or wells are preferably created or provided along at least 1%, 5%, 10%, 20%, 30%, 40%, 50%, 60%, 70%, 80%, 90% or 95% of the central longitudinal axis of the ion guide.

The plurality of first axial time averaged or pseudo-potential barriers, corrugations or wells are preferably created or provided at an upstream portion and/or an intermediate portion and/or a downstream portion of the ion guide.

According to an embodiment the ion guide, preferably has a length L and the plurality of first axial time averaged or pseudo-potential barriers, corrugations or wells are preferably created or provided at one or more regions or locations having a displacement along the length of the ion guide selected from the group consisting of: (i) 0-0.1 L; (ii) 0.1-0.2 L; (iii) 0.2-0.3 L; (iv) 0.3-0.4 L; (v) 0.4-0.5 L; (vi) 0.5-0.6 L; (vii) 0.6-0.7 L; (viii) 0.7-0.8 L; (ix) 0.8-0.9 L; and (x) 0.9-2.0 L.

The plurality of first axial time averaged or pseudo-potential barriers, corrugations or wells preferably extend at least r mm in a radial direction away from the central longitudinal axis of the ion guide, wherein r is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; and (xi) >10.

According to an embodiment for ions having mass to charge ratios falling within a range 1-100, 100-200, 200-300, 300-400, 400-500, 500-600, 600-700, 700-800, 800-900 or 900-1000 the amplitude, height or depth of at least 1%, 5%, 10%, 20%, 30%, 40%, 50%, 60%, 70%, 80%, 90%, 95% or 100% of the first axial time averaged or pseudo-potential barriers, corrugations or wells is preferably selected from the group consisting of; (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V.

Preferably, at least 1, 2, 3, 4, 5, 6, 7, 8, 9 or 10 first axial time averaged or pseudo-potential barriers, corrugations or wells are provided or created, in use, per cm along at least a portion of the axial length, of the ion guide.

The plurality of first, axial time averaged or pseudo-potential barriers, corrugations or wells preferably have minima along the axial length of the ion guide which preferably correspond with the axial location of the plurality of electrodes.

The plurality of first axial time averaged or pseudo-potential barriers, corrugations or wells preferably have maxima along the axial length of the ion guide located at axial locations which preferably correspond with substantially 50% of the axial distance or separation between neighbouring electrodes.

The plurality of first axial time averaged or pseudo-potential barriers, corrugations or wells preferably have minima and/or maxima which are substantially the same height, depth or amplitude for ions having a particular mass to charge ratio and wherein the minima and/or maxima preferably have a periodicity which is substantially the same as or a multiple of the axial displacement or separation of the plurality of electrodes.

According to an embodiment the mass analyser preferably comprises third means arranged and adapted to progressively increase, progressively decrease, progressively vary, scan, linearly increase, linearly decrease, increase in a stepped, progressive or other manner or decrease in a stepped, progressive or other manner the amplitude of the first AC or RF voltage applied to the electrodes.

The third means is preferably arranged and adapted to progressively increase, progressively decrease, progressively vary, scan, linearly increase, linearly decrease, increase in a stepped, progressive or other manner or decrease in a stepped, progressive or other manner the amplitude of the first AC or RF voltage by $x_3$ Volts over a time period $t_3$. Preferably, $x_3$ is selected from the group consisting of: (i) <50 V peak to peak; (ii) 50-100 V peak to peak; (iii) 100-150 V peak to peak; (iv) 150-200 V peak, to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak. Preferably, $t_3$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The mass analyser preferably further comprises fourth means arranged and adapted to progressively increase, progressively decrease, progressively vary, scan, linearly increase, linearly decrease, increase in a stepped, progressive or other manner or decrease in a stepped, progressive or other manner the frequency of the first RF or AC voltage applied to the electrodes. The fourth means is preferably arranged and adapted to progressively increase, progressively decrease, progressively vary, scan, linearly increase, linearly decrease, increase in a stepped, progressive or other manner or decrease in a stepped, progressive or other manner the frequency of the first RF or AC voltage applied to the electrodes by $x_4$ MHz over a time period $t_4$. Preferably, $x_4$ is selected from the group consisting of; (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9-0 MHz; (xxiii) 9.0-9.5 MHz; (xxiv) 9.5-10.0 MHz; and (xxv) >10.0 MHz. Preferably, $t_4$ is selected from the group consisting of; (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an embodiment the second AC or RF voltage preferably has an amplitude selected from, the group consisting of: (i) <50 V peak to peak; (ii) 50-100 V peak to peak; (iii) 100-150 V peak to peak; (iv) 150-200 V peak to peak; (v) 200-2.50 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak (xxix) 900-950 V peak to peak; (xxx) 950-1000 V peak to peak; and (xxxi) >1000 V peak to peak.

The second AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The means for applying the second AC or RF voltage is preferably arranged to apply the second AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the plurality of electrodes and/or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50 or >50 of the plurality of electrodes.

The means for applying the second AC or RF voltage is preferably arranged to supply axially adjacent electrodes or axially adjacent groups of electrodes with opposite phases of the second AC or RF voltage.

The one or more second axial time averaged or pseudo-potential barriers, corrugations or wells are preferably created, in use, along at least 1%, 5%, 10%, 20%, 30%, 40%, 50%, 60%, 70%, 80%, 90% or 95% of the axial length of the ion guide.

The one or more second axial time averaged or pseudo-potential barriers, corrugations or wells are preferably created or provided along at least 1%, 5%, 10%, 20%, 30%, 40%, 50%, 60%, 70%, 80%, 90% or 95% of the central longitudinal axis of the ion guide.

The plurality of second axial time averaged or pseudo-potential barriers, corrugations or wells are preferably created or provided at an upstream portion and/or an intermediate portion and/or a downstream portion of the ion guide.

The ion guide preferably has a length L and the plurality of second axial time averaged or pseudo-potential barriers, corrugations or wells are preferably created or provided at one or more regions or locations having a displacement along the length of the ion guide selected from the group consisting of; (i) 0-0.1 L; (ii) 0.1-0.2 L; (iii) 0.2-0.3 L; (iv) 0.3-0.4 L; (v) 0.4-0.5 L; (vi) 0.5-0.6 L; (vii) 0.6-0.7 L; (viii) 0.7-0.8 L; (ix) 0.8-0.9 L; and (x) 0.9-1.0 L.

The one or more second axial time averaged or pseudo-potential barriers, corrugations or wells preferably extend at least r mm in a radial direction away from the central longitudinal axis of the ion guide, wherein r is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; and (xi) >10.

According to an embodiment for ions having mass to charge ratios failing within a range 1-100, 100-200, 200-300, 300-400, 400-500, 500-600, 600-700, 700-800, 800-900 or 900-1000 the amplitude, height or depth of at least 1%, 5%, 10%, 20%, 30%, 40%, 50%, 60%, 70%, 80%, 90%, 95% or 100% of the one or more second axial time averaged or pseudo-potential barriers, corrugations or wells is preferably selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V.

Preferably, at least 1, 2, 3, 4, 5, 6, 7, 8, 9 or 10 of the second axial time averaged or pseudo-potential barriers, corrugations or wells are provided or created, in use, per cm along the axial length of the ion guide.

The one or more second axial time averaged or pseudo-potential barriers, corrugations or wells preferably have minima along the axial length of the ion guide which correspond with the axial location of the plurality of electrodes.

The one or more second axial time averaged or pseudo-potential barriers, corrugations or wells preferably have maxima along the axial length of the ion guide located at axial locations which preferably correspond with substantially 50% of the axial distance or separation between neighbouring electrodes.

The one or more second axial time averaged or pseudo-potential barriers, corrugations or wells preferably have minima and/or maxima which are substantially the same height, depth or amplitude for ions having a particular mass to charge ratio. The minima and/or maxima preferably have a periodicity which is preferably substantially the same as or a multiple of the axial displacement or separation of the plurality of electrodes.

According to the preferred embodiment the second amplitude is preferably less than or greater than the first amplitude. Preferably, the ratio of the second amplitude to the first amplitude is selected from the group consisting of: (i) <1; (ii) >1; (iii) 1-2; (iv) 2-3; (v) 3-4; (vi) 4-5; (vii) 5-6; (viii) 6-7; (ix) 7-8; (x) 8-9; (xi) 9-10; (xii) 10-11; (xiii) 11-12; (xiv) 12-13; (xv) 13-14; (xvi) 14-15; (xvii) 15-16; (xviii) 16-17; (xix) 17-18; (xx) 18-19; (xxi) 19-20; (xxii) 20-25; (xxiii) 25-30; (xxiv) 30-35; (xxv) 35-40; (xxvi) 40-45; (xxvii) 45-50; (xxviii) 50-60; (xxix) 60-70; (xxx) 70-80; (xxxi) 80-90; (xxxii) 90-100; and (xxxiii) >100.

According to an embodiment the mass analyser further comprises fifth means arranged and adapted to progressively increase, progressively decrease, progressively vary, scan, linearly increase, linearly decrease, increase in a stepped, progressive or other manner or decrease in a stepped, progressive or other manner the amplitude of the second AC or RF voltage applied to one or more of the plurality of electrodes.

The fifth means is preferably arranged and adapted to progressively increase, progressively decrease, progressively vary, scan, linearly increase, linearly decrease, increase in a stepped, progressive or other manner or decrease in a stepped, progressive or other manner the amplitude of the second AC or RF voltage by $x_5$ Volts over a time period $t_5$. Preferably, $x_5$ is selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak, to peak. Preferably, $t_5$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 0.90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ins; (xix) 800-900 ms; (xx) 900-1000 ms; (xxi) 1-2 s; (xxii) 2-3 s; (xxiii) 3-4 s; (xxiv) 4-5 s; and (xxv) >5 s.

The mass analyser preferably further comprises sixth means arranged and adapted to progressively increase, progressively decrease, progressively vary, scan, linearly increase, linearly decrease, increase in a stepped, progressive or other manner or decrease in a stepped, progressive or other manner the frequency of the second RF or AC voltage applied to one or more of the plurality of electrodes.

The sixth means is preferably arranged and adapted to progressively increase, progressively decrease, progressively vary, scan, linearly increase, linearly decrease, increase in a stepped, progressive or other manner or decrease in a stepped, progressive or other manner the frequency of the second RF or AC voltage applied to the electrodes by $x_6$ MHz over a time period $t_6$. Preferably, $x_6$ is selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz. Preferably, $t_6$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms;

(xix) 800-900 ms; (xx) 900-1000 ma; (xxi) 1-2 s; (xxii) 2-3 s; (xxiii) 3-4 s; (xxiv) 4-5 s; and (xxv) >5 s.

The mass analyser preferably further comprises means for applying a first DC voltage to one or more of the plurality of electrodes such that, in use, the one or more second axial time averaged or pseudo-potential barriers, corrugations or wells preferably comprise a DC axial potential barrier or well in combination with an axial time averaged or pseudo-potential barrier or well.

According to an embodiment the mass analyser further comprises seventh means arranged and adapted to progressively increase, progressively decrease, progressively vary, scan, linearly increase, linearly decrease, increase in a stepped, progressive or other manner or decrease in a stepped, progressive or other manner the amplitude of the first DC voltage applied to one or more of the plurality of electrodes.

The seventh means is preferably arranged and adapted to progressively increase, progressively decrease, progressively vary, scan, linearly increase, linearly decrease, increase in a stepped, progressive or other manner or decrease in a stepped, progressive or other manner the amplitude of the first DC voltage by $x_7$ Volts over a time period $t_7$. Preferably, $x_7$ is selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V. Preferably, $t_7$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The mass analyser preferably further comprises means for applying a third AC or RF voltage to one or more of the plurality of electrodes such that, in use, one or more third axial time averaged or pseudo-potential barriers, corrugations or wells having a third amplitude are created along at least a portion of the axial length of the ion guide. The third amplitude is preferably different from the first amplitude and/or the second amplitude. According to an embodiment the third amplitude may be the same as the second amplitude but different from the first amplitude.

The third AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak, to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak.

The third AC or RF voltage preferably has a frequency selected from the group consisting of; (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 Mite; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The means for applying the third AC or RF voltage is preferably arranged to apply the third AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the plurality of electrodes.

The means for applying the third AC or RF voltage is preferably arranged to supply axially adjacent electrodes or axially adjacent, groups of electrodes with opposite phases of the third AC or RF voltage.

The one or more third axial time averaged or pseudo-potential barriers, corrugations or wells are preferably created, in use, along at least 1%, 5%, 10%, 20%, 30%, 40%, 50%, 60%, 70%, 80%, 90% or 95% of the axial length of the ion guide.

The one or more of third axial time averaged or pseudo-potential barriers, corrugations or wells are preferably created or provided along at least 1%, 5%, 10%, 20%, 30%, 40%, 50%, 60%, 70%, 80%, 90% or 0.95% of the central longitudinal axis of the ion guide.

The one or more of third, axial time averaged or pseudo-potential barriers, corrugations or wells are preferably created or provided at an upstream portion and/or an intermediate portion and/or a downstream portion of the ion guide.

The ion guide preferably has a length L and the one or more third axial time averaged or pseudo-potential barriers, corrugations or wells are preferably created or provided at one or more regions or locations having a displacement along the length of the ion guide selected from the group consisting of: (i) 0-0.1 L; (ii) 0.1-0.2 L; (iii) 0.2-0.3 L; (iv) 0.3-0.4 L; (v) 0.4-0.5 L; (vi) 0.5-0.6 L; (vii) 0.6-0.7 L; (viii) 0.7-0.8 L; (ix) 0.8-0.9 L; and (x) 0.9-1.0 L.

The one or more of third axial time averaged or pseudo-potential barriers, corrugations or wells preferably extend at least r mm in a radial direction away from the central longitudinal axis of the ion guide, wherein r is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; and (xi) >10.

According to an embodiment, for ions having mass to charge ratios falling within a range 1-100, 100-200, 200-300, 300-4.00, 400-500, 500-600, 600-700, 700-800, 800-900 or 900-1000 the amplitude, height or depth of at least 1%, 5%, 10%, 20%, 30%, 40%, 50%, 60%, 70%, 80%, 90%, 95% or 100% of the third axial time averaged or pseudo-potential barriers, corrugations or wells is selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1-5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V.

According to an embodiment at least 1, 2, 3, 4, 5, 6, 7, 8, 9 or 10 third axial time averaged or pseudo-potential barriers, corrugations or wells are provided or created, in use, per cm along the axial length of the ion guide.

The one or more third axial time averaged or pseudo-potential barriers, corrugations or wells preferably have minima along the axial length of the ion guide which preferably correspond with the axial location of the plurality of electrodes.

The one or more third axial time averaged or pseudo-potential barriers, corrugations or wells preferably have maxima along the axial length of the ion guide located at axial locations which preferably correspond, with substantially 50% of the axial distance or separation between, neighbouring electrodes.

The one or more third axial time averaged or pseudo-potential barriers, corrugations or wells preferably have minima and/or maxima which are substantially the same height, depth or amplitude for ions having a particular mass to charge ratio and wherein the minima and/or maxima have a periodicity which is substantially the same as or a multiple of the axial displacement or separation of the plurality of electrodes.

The third amplitude is preferably less than or greater than the first amplitude and/or the second amplitude. The ratio of the third amplitude to the first amplitude is preferably selected from the group consisting of: (i) <1; (ii) >1; (iii) 1-2; (iv) 2-3; (v) 3-4; (vi) 4-5; (vii) 5-6; (viii) 6-7; (ix) 7-8; (x) 8-3; (xi) 9-10; (xii) 10-11; (xiii) 11-12; (xiv) 12-13; (xv) 13-14; (xvi) 14-15; (xvii) 15-16; (xviii) 16-17; (xix) 17-18; (xx) 18-19; (xxi) 19-20; (xxii) 20-25; (xxiii) 25-30; (xxiv) 30-35; (xxv) 35-40; (xxvi) 40-45; (xxvii) 45-50; (xxviii) 50-60; (xxix) 60-70; (xxx) 70-80; (xxxi) 80-90; (xxxii) 90-100; and (xxxiii) >100.

The ratio of the third amplitude to the second amplitude is preferably selected from the group consisting of; (i) <1; (ii) >1; (iii) 1-2; (iv) 2-3; (v) 3-4; (vi) 4-5; (vii) 5-6; (viii) 6-7; (ix) 7-8; (x) 8-9; (xi) 9-10; (xii) 10-11; (xiii) 11-12; (xiv) 12-13; (xv) 13-14; (xvi) 14-15; (xvii) 15-16; (xviii) 0.16-17; (xix) 17-18; (xx) 18-19; (xxi) 0.19-20; (xxii) 20-25; (xxiii) 25-30; (xxiv) 30-35; (xxv) 35-40; (xxvi) 40-45; (xxvii) 45-50; (xxviii) 50-60; (xxix) 50-70; (xxx) 70-80; (xxxi) 80-90; (xxxii) 90-100; and (xxxiii) >100.

The mass analyser may further comprise eighth means arranged and adapted to progressively increase, progressively decrease, progressively vary, scan, linearly increase, linearly decrease, increase in a stepped, progressive or other manner or decrease in a stepped, progressive or other manner the amplitude of the third AC or RF voltage applied to the one or more of the plurality of electrodes.

The eighth means is preferably arranged and adapted to progressively increase, progressively decrease, progressively vary, scan, linearly increase, linearly decrease, increase in a stepped, progressive or other manner or decrease in a stepped, progressive or other manner the amplitude of the third AC or RF voltage by $x_8$ Volts over a time period $t_8$. Preferably, $x_8$ is selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak. Preferably, $t_8$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an embodiment the mass analyser preferably further comprises ninth means arranged and adapted to progressively increase, progressively decrease, progressively vary, scan, linearly increase, linearly decrease, increase in a stepped, progressive or other manner or decrease in a stepped, progressive or other manner the frequency of the third RF or AC voltage applied to the one or more of the plurality of electrodes.

The ninth means is preferably arranged and adapted to progressively increase, progressively decrease, progressively vary, scan, linearly increase, linearly decrease, increase in a stepped, progressive or other manner or decrease in a stepped, progressive or other manner the frequency of the third RF or AC voltage applied to one or more of the plurality of electrodes by $x_9$ MHz over a time period $t_9$. Preferably, $x_9$ is selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz. Preferably, $t_9$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The mass analyser preferably further comprises means for applying a second DC voltage to one or more of the plurality of electrodes such that, in use, the one or more third axial, time averaged or pseudo-potential barriers, corrugations or wells comprise a DC axial potential barrier or well in combination with an axial time averaged or pseudo-potential barrier or well.

The mass analyser preferably further comprises tenth means arranged and adapted to progressively increase, progressively decrease, progressively vary, scan, linearly increase, linearly decrease, increase in a stepped, progressive or other manner or decrease in a stepped, progressive or other manner the amplitude of the second DC voltage applied to one or more of the plurality of electrodes.

The tenth means is preferably arranged and adapted to progressively increase, progressively decrease, progressively vary, scan, linearly increase, linearly decrease, increases in a stepped, progressive or other manner or decrease in a stepped, progressive or other manner the amplitude of the second DC voltage by $x_{10}$ Volts over a time period $t_{10}$. Preferably, $x_{10}$ is selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 v; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V. Preferably, $t_{10}$ is selected from the group consisting of: (i) <1 ms; (ii) 1-10 as; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an embodiment the mass analyser further comprises eleventh means arranged and adapted to progressively increase, progressively decrease, progressively vary, scan, linearly increase, linearly decrease, increase in a stepped, progressive or other manner or decrease in a stepped, progressive or other manner the amplitude of a DC voltage or potential applied to at least some of the electrodes of the ion guide and which acts to confine ions in a radial direction within the ion guide.

The eleventh means is preferably arranged and adapted to progressively increase, progressively decrease, progressively vary, scan, linearly increase, linearly decrease, increase in a stepped, progressive or other manner or decrease in a stepped, progressive or other manner the amplitude of the DC voltage or potential applied to the at least some electrodes by $x_{11}$ Volts over a time period $t_{11}$. Preferably, $x_{11}$, is selected from the group consisting of; (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V. Preferably, $t_{11}$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 0.1-2 s; (xxii) 2-3 s; (xxiii) 3-4 s; (xxiv) 4-5 s; and (xxv) >5 s.

The mass analyser preferably further comprises means for maintaining in a mode of operation the ion guide at a pressure selected from the group consisting of: (i) $<1.0\times10^{-1}$ mbar; (ii) $<1.0\times10^{-2}$ mbar; (iii) $<1.0\times10^{-3}$ mbar; and (iv) $<1.0\times10^{-4}$ mbar.

The mass analyser preferably further comprises means for maintaining in a mode of operation the ion guide at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v) >10 mbar; (vi) >100 mbar; (vii) $>5.0\times10^{-3}$ mbar; (viii) $>5.0\times10^{-2}$ mbar; (ix) $10^{-4}$–$10^{-3}$ mbar; (x) $10^{-1}$–$10^{-2}$ mbar; and (xi) $10^{-2}$–$10^{-1}$ mbar.

The mass analyser preferably further comprises means arranged and adapted to progressively increase, progressively decrease, progressively vary, scan, linearly increase, linearly decrease, increase in a stepped, progressive or other manner or decrease in a stepped, progressive or other manner the gas flow through the ion guide.

According to an embodiment in a mode of operation ions are preferably arranged to be trapped but are not substantially fragmented within the ion guide.

The mass analyser may further comprise, means for collisionally cooling or substantially thermalising ions within the ion guide.

The mass analyser may further comprise means for substantially fragmenting ions within the ion guide in a mode of operation.

The mass analyser may further comprise one or more electrodes arranged at the entrance and/or exit of the ion guide, wherein in a mode of operation the one or more electrodes are arranged to pulse ions into and/or out of the ion guide.

According to another aspect of the present invention there is provided a mass spectrometer comprising a mass analyser as discussed above.

The mass spectrometer preferably comprises an ion source selected from the group consisting of: (i) an Electrospray ionisation ("ESI") ion source; (ii) an Atmospheric Pressure Photo Ionisation ("APPT") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIGS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; and (xvii) a Thermospray ion source.

The mass spectrometer preferably comprises a continuous or pulsed ion source.

The mass spectrometer preferably further comprises one or more mass filters arranged upstream and/or downstream of the mass analyser. The one or more mass filters are preferably selected from the group consisting of: (i) a quadrupole rod set mass filter; (ii) a Time of Flight mass filter or mass analyser; (iii) a Wein filter; and (iv) a magnetic sector mass filter or mass analyser.

The mass spectrometer preferably further comprises one or more second ion guides or ion traps arranged upstream and/or downstream of the mass analyser. The one or more second ion guides or ion traps are preferably selected from the group consisting of:

(i) a multipole rod set or a segmented multipole rod set-ion guide or ion trap comprising a quadrupole rod set, a hexapole rod set, an octapole rod set or a rod set comprising more than eight rods;

(ii) an ion tunnel or ion funnel ion guide or ion trap comprising a plurality of electrodes or at least 2, 5, 10, 20, 30, 40, 50, 60, 70, 80, 90 or 100 electrodes having apertures through which ions are transmitted in use, wherein at least 1%, 5%, 10%, 15%, 20%, 25%, 30%, 35%, 40%, 45%, 50%, 55%, 60%, 65%, 70%, 75%, 80%, 85%, 90%, 95% or 100% of the electrodes have apertures which are of substantially the same size or area or which have apertures which become progressively larger and/or smaller in size or in area;

(iii) a stack or array of planar, plate or mash electrodes, wherein the stack, or array of planar, plate or mesh electrodes comprises a plurality or at least 2, 3, 4, 5, 6, 7, 8, 9, 10, 11, 12, 13, 14, 15, 16, 17, 18, 19 or 20 planar, plate or mesh electrodes or at least 1%, 5%, 10%, 15%, 20%, 25%, 30%, 35%, 40%, 45%, 50%, 55%, 60%, 65%, 70%, 75%, 80%, 85%, 90%, 95% or 100% of the planar, plate or mesh electrodes are arranged generally in the plane in which ions travel in use; and (iv) an ion trap or ion guide comprising a plurality of groups of electrodes arranged axially along the length of the ion trap or ion guide, wherein each group of electrodes comprises: (a) a first and a second electrode and means for applying a DC voltage or potential to the first and second electrodes in order to confine ions in a first radial direction within the ion guide; and (b) a third and a fourth electrode and means for applying an AC or RF voltage to the third and fourth electrodes in order to confine ions in a second radial direction within the ion guide, wherein the second radial direction is preferably orthogonal to the first radial direction.

According to a preferred embodiment the second ion guide or ion trap preferably comprises an ion tunnel or ion funnel ion guide or ion trap and wherein at least 1%, 5%, 10%, 15%, 20%, 25%, 30%, 35%, 40%, 45%, 50%, 55%, 60%, 65%, 70%, 75%, 80%, 85%, 90%, 95% or 100% of the electrodes have internal diameters or dimensions selected from the group consisting of: (i) ≤1.0 mm; (ii) ≤2.0 mm; (iii) ≤3.0 mm; (iv) ≤4.0 mm; (v) ≤5.0 mm; (vi) ≤6.0 mm; (vii) ≤7.0 mm; (viii) ≤8.0 mm; (ix) ≤9.0 mm; (x) ≤10.0 mm; and (xi) >10.0 mm.

The second ion guide or ion trap preferably comprises fourth AC or RF voltage means arranged and adapted to apply an AC or RF voltage to at least 1%, 5%, 10%, 15%, 20%, 25%, 30%, 35%, 40%, 45%, 50%, 55%, 60%, 65%, 70%, 75%, 80%, 85%, 90%, 95% or 100% of the plurality of electrodes of the second ion guide or ion trap in order to confine ions radially within the second ion guide or ion trap.

The second ion guide or ion trap is preferably arranged and adapted to receive, a beam or group of ions from the mass analyser and to convert or partition the beam or group of ions such that at least 1, 2, 3, 4, 5, 6, 7, 8, 9, 10, 11, 12, 13, 14, 15, 16, 17, 18, 19 or 20 separate packets of ions are confined and/or isolated within the second ion guide or ion trap at any particular time. Each packet of ions is preferably separately confined and/or isolated in a separate axial potential well formed in the second ion guide or ion trap.

The mass spectrometer preferably further comprises means arranged and adapted to urge at least some ions upstream and/or downstream through or along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial length of the second ion guide or ion trap in a mode of operation.

According to an embodiment the mass spectrometer further comprises transient DC voltage means arranged and adapted to apply one or more transient DC voltages or potentials or one or more transient DC voltage or potential waveforms to the electrodes forming the second ion guide or ion trap in order to urge at least, some ions downstream and/or upstream along at least 1%, 5%, 10%, 15%, 20%, 25%, 30%, 35%, 40%, 45%, 50%, 55%, 60%, 65%, 70%, 75%, 80%, 85%, 90%, 95% or 100% of the axial length of the second ion guide or ion trap.

According to an embodiment the mass spectrometer preferably further comprises AC or RF voltage means arranged and adapted to apply two or more phase-shifted AC or RF voltages to electrodes forming the second ion guide or ion trap in order to urge at least some ions downstream and/or upstream along at least 1%, 5%, 10%, 1.5%, 20%, 25%, 30%, 35%, 40%, 45%, 50%, 55%, 60%, 65%, 70%, 75%, 80%, 85%, 90%, 95% or 100% of the axial length of the second ion guide or ion trap.

The mass spectrometer preferably further comprises means arranged and adapted to maintain at least, a portion of the second ion guide or ion trap at a pressure selected from the group consisting oft (i) >0.0001 mbar; (ii) >0.001 mbar; (iii) >0.01 mbar; (iv) >0.1 mbar; (v) >1 mbar; (vi) >0.10 mbar; (vii) >1 mbar; (viii) 0.0001-100 mbar; and (ix) 0.001-10 mbar.

The mass spectrometer may further comprise a collision, fragmentation or reaction device arranged and adapted to fragment ions by Collision. Induced Dissociation ("CID"). According to another embodiment the mass spectrometer may further comprise a collision, fragmentation or reaction device selected from the group consisting of; (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product, ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; and (xxvii) an ion-metastable atom reaction device for reacting ions to form adduct or product ions.

According to an embodiment the mass spectrometer preferably further comprises means arranged and adapted to progressively increase, progressively decrease, progressively vary, scan, linearly increase, linearly decrease, increase in a stepped, progressive or other manner or decrease in a stepped, progressive or other manner the potential difference between the mass analyser and the collision, fragmentation or reaction cell preferably during or over the cycle time of the mass analyser.

According to an embodiment the mass spectrometer further comprises a further mass analyser arranged upstream and/or downstream of the mass analyser. The further mass analyser is preferably selected from, the group consisting of: (i) a Fourier Transform ("FT") mass analyser; (ii) a Fourier Transform Ion Cyclotron Resonance ("FTICR") mass analyser; (iii) a Time of Flight ("TOF") mass analyser; (iv) an orthogonal acceleration. Time of Flight ("oaTOF") mass analyser; (v) an axial acceleration Time of Flight mass analyser; (vi) a magnetic sector mass spectrometer; (vii) a Paul or 3D quadrupole mass analyser; (viii) a 2D or linear quadrupole mass analyser; (ix) a Penning trap mass analyser; (x) an ion trap mass analyser; (xi) a Fourier Transform orbitrap; (xii) an electrostatic Ion Cyclotron Resonance mass spectrometer; (xiii) an electrostatic Fourier Transform mass spectrometer; and (xiv) a quadrupole rod set mass filter or mass analyser.

The mass spectrometer preferably further comprises means arranged and adapted to progressively increase, progressively decrease, progressively vary, scan, linearly increase, linearly decrease, increase in a stepped, progressive or other manner or decrease in a stepped, progressive or other manner the mass to charge ratio transmission window of the further analyser in synchronism with the operation of the mass analyser during or over the cycle time of the mass analyser.

According to an aspect of the present invention there is provided a method of mass analysing ions comprising:

providing an ion guide comprising a plurality of electrodes;

applying a first AC or RF voltage to at least some of the plurality of electrodes such that a plurality of first axial time averaged or pseudo-potential barriers, corrugations or wells are created along at least a portion of the axial length of the ion guide;

driving or urging ions along at least a portion of the axial length of the ion guide; and applying a second AC or RF voltage to one or more of the plurality of electrodes such that one or more second axial time averaged or pseudo-potential barriers, corrugations or wells are created along at least a portion of the axial length of the ion guide, wherein the second amplitude is different from said first amplitude.

According to an aspect of the present invention there is provided a mass analyser comprising:

an ion guide comprising a plurality of electrodes having apertures through which ions are transmitted in use;

means for applying a first AC or RF voltage to one or more of the plurality of electrodes in order to confine ions radially within the ion guide; and means for applying a second different AC or RF voltage to one or more of the plurality of electrodes such that, in use, one or more axial time averaged or pseudo-potential barriers, corrugations or wells are created along at least a portion of the axial length of the ion guide.

According to an aspect of the present invention there is provided a method of mass analysing ions comprising:

providing an ion guide comprising a plurality of electrodes having apertures through which ions are transmitted;

applying a first AC or RF voltage to one or more of the plurality of electrodes in order to confine ions radially within the ion guide; and applying a second different AC or SF voltage to one or more of the plurality of electrodes such that one or more axial time averaged or pseudo-potential barriers, corrugations or wells are created along at least a portion of the axial length of the ion guide.

According to an aspect of the present invention there is provided a mass analyser comprising;

an ion guide comprising a plurality of electrodes, the plurality of electrodes comprising electrodes having an aperture through which ions are transmitted in use;

means for applying a first AC or RF voltage to at least some of the plurality of electrodes so that axially adjacent groups of electrodes are supplied with opposite phases of the first AC or RF voltage and wherein, in use, a plurality of first axial time averaged or pseudo-potential barriers, corrugations or wells having a first amplitude are created along at least a portion of the axial length of the ion guide; and means for reversing the polarity of the first AC or RF voltage applied to one or more axially adjacent groups of electrodes such that, in use, one or more second axial, time averaged or pseudo-potential barriers, corrugations or wells having a second amplitude are created along at least a portion of the axial length of the ion guide, wherein the second amplitude is different from the first amplitude.

Each group of electrodes may comprise 1, 2, 3, 4, 5, 6, 7, 8, 9, 10 or >20 electrodes.

According to an aspect of the present invention there is provided a method of mass analysing ions comprising:

providing an ion guide comprising a plurality of electrodes, the plurality of electrodes comprising electrodes having an aperture through which ions are transmitted;

applying a first AC or RF voltage to at least some of the plurality of electrodes so that axially adjacent groups of electrodes are supplied with opposite phases of the first AC or RF voltage and wherein plurality of first axial time averaged or pseudo-potential harriers, corrugations or wells having a first amplitude are created along at least a portion of the axial length of the ion guide; and reversing the polarity of the first AC or RF voltage applied to one or more axially adjacent groups of electrodes such that one or more second axial time averaged or pseudo-potential barriers, corrugations or wells having a second amplitude are created along at least a portion of the axial length of the ion guide, wherein the second amplitude is different from the first amplitude.

According to an aspect of the present invention there is provided a mass analyser comprising:

an ion guide comprising a plurality of electrodes, the plurality of electrodes comprising electrodes having an aperture through which ions are transmitted in use;

means for applying a first AC or RF voltage to at least some of the plurality of electrodes so that axially adjacent electrodes or axially adjacent groups of electrodes are supplied with opposite phases of the first AC or RF voltage and wherein, in use, a plurality of first, axial time averaged or pseudo-potential barriers, corrugations or wells having a first amplitude are created along at least a portion of the axial length of the ion guide;

means for applying one or more transient DC voltages or potentials or one or more transient DC voltage or potential waveforms to the plurality of electrodes in order to drive or urge ions along at least a portion of the axial length of the ion guide;

means for reversing the polarity of the first AC or RF voltage applied to a pair of axially adjacent electrodes or a pair of axially adjacent groups of electrodes such that, in use, one or more second axial time averaged or pseudo-potential barriers, corrugations or wells having a second amplitude are created along at least a portion of the axial length of the ion guide, wherein the second amplitude is different from the first amplitude; and means for progressively decreasing in a linear, stepped, or other manner the amplitude of the first AC or RF voltage so as to progressively reduce the amplitude of the one or more second axial time averaged or pseudo-potential barriers, corrugations or wells.

Preferably, the means for progressively decreasing the amplitude of the first AC or RF voltage is arranged to progressively decrease the amplitude of the first AC or RF voltage by $x_{12}$ Volts over a time period $t_{12}$. Preferably, $x_{12}$ is selected from the group consisting of; (i) <50 V peak to peak; (ii) 50-100 V peak to peak; (iii) 1.00-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak, to peak; (xxviii) 850-900 V peak to peak; (xxix) 900-950 V peak to peak; (xxx) 950-1000 V peak to peak; and (xxxi) >1000 V peak to peak. Preferably, $t_{12}$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an aspect of the present invention there is provided a method of mass analysing comprising:

providing an ion guide comprising a plurality of electrodes, the plurality of electrodes comprising electrodes having an aperture through which ions are transmitted;

applying a first AC or RF voltage to at least some of the plurality of electrodes so that axially adjacent electrodes or axially adjacent groups of electrodes are supplied with opposite phases of the first AC or RF voltage and wherein a plurality of first axial time averaged or pseudo-potential barriers, corrugations or wells having a first amplitude are created along at least a portion of the axial length of the ion guide;

applying one or more transient DC voltages or potentials or one or more transient DC voltage or potential waveforms to the plurality of electrodes in order to drive or urge ions along at least a portion of the axial length of the ion guides;

reversing the polarity of the first AC or RF voltage applied to a pair of axially adjacent electrodes or a pair of axially adjacent groups of electrodes such that one or more second axial time averaged or pseudo-potential barriers, corrugations or wells having a second amplitude are created along at least a portion of the axial length of the ion guide, wherein the second amplitude is different from the first amplitude; and progressively decreasing in a linear, stepped or other manner the amplitude of the first AC or RF voltage so as to progressively reduce the amplitude of the one or more second axial time averaged or pseudo-potential barriers, corrugations or wells.

According to an aspect of the present invention there is provided an ion guide or mass analyser comprising:

a plurality of electrodes;

means for applying a first AC or RF voltage to the plurality of electrodes so that at least some electrodes are maintained, in use, at opposite phases of the first AC or RF voltage; and means for varying, switching, changing or scanning the phase difference or polarity of one or more electrodes so as to create, in use, an axial time averaged or pseudo-potential barrier along at least a portion of the axial length of the ion guide or mass analyser.

The means for varying, switching, changing or scanning the phase difference or polarity of the one or more electrodes is preferably arranged to vary, switch, change or scan the phase difference or polarity by θ°, wherein θ is selected from the group consisting of: (i) <10; (ii) 10-20; (iii) 20-30; (iv) 30-40; (v) 40-50; (vi) 50-60; (vii) 60-70; (viii) 70-80; (ix) 80-90; (x) 90; (xi) 90-100; (xii) 100-110; (xiii) 110-120; (xiv) 120-130; (xv) 130-140; (xvi) 140-150; (xvii) 150-160; (xviii) 160-170; (xix) 170-180; and (xx) 180.

According to an aspect of the present invention there is provided a method of guiding ions or mass analysing ions comprising:

providing an ion guide or mass analyser comprising a plurality of electrodes;

applying a first AC or RF voltage to the plurality of electrodes so that at least some electrodes are maintained at opposite phases of the first AC or RF voltage; and varying, switching, changing or scanning the phase difference or polarity of one or more electrodes so as to create an axial time averaged or pseudo-potential barrier along at least a portion of: the axial length of the ion guide or mass analyser.

Preferably, the step of varying, switching, changing or scanning the phase difference or polarity of the one or more electrodes comprises varying, switching, changing or scanning the phase difference or polarity by θ°, wherein θ is selected from the group consisting of; (i) <10; (ii) 10-20; (iii) 20-30; (iv) 30-40; (v) 40-50; (vi) 50-60; (vii) 60-70; (viii) 70-80; (ix) 80-90; (x) 90; (xi) 90-100; (xii) 100-110; (xiii) 110-120; (xiv) 120-130; (xv) 130-140; (xvi) 140-150; (xvii) 150-160; (xviii) 160-170; (xix) 170-180; and (xx) 180.

According to a preferred embodiment, of the present invention an RF ion guide is provided which is arranged to confine ions radially within the ion guide about a central axis. One or more pseudo-potential barriers are preferably maintained at one or more points along the central axis of the ion guide. The magnitude of the one or more pseudo-potential barriers preferably depends upon the mass to charge ratio of an ion. The one or more pseudo-potential barriers may be positioned at the entrance and/or at the exit of the ion guide. Other embodiments are contemplated wherein one or more pseudo-potential barriers may be located at one or more positions along the length of the ion guide between the entrance and the exit of the ion guide.

The RF ion guide preferably comprises a stack of annular electrodes having apertures through which ions are transmitted in use. Opposite phases of an RF voltage are preferably applied to alternate electrodes in order to confine ions radially within the ion guide. The ion guide preferably comprises a ring stack or ion tunnel ion guide.

Ions are preferably propelled along and through the ion guide by one or more transient DC voltages or potentials or one or more transient DC voltage or potential waveforms which are preferably applied to the electrodes of the ion guide. If the amplitude of the one or more transient DC voltages or potentials or the one or more transient DC voltage or potential waveforms is substantially less than that of the effective pseudo-potential barrier for ions having a particular mass to charge ratio value, then these ions will not be driven over or through the pseudo-potential barrier. As a result, these ions will remain confined within the ion guide. If the amplitude of the one or more transient DC voltages or potentials or the one or more transient DC voltage or potential waveforms is substantially greater than that of the effective pseudo-potential barrier for ions having a particular mass to charge ratio value then these ions will be driven over or through the pseudo-potential barrier and hence will exit the ion guide.

Ions may be driven progressively over a pseudo-potential barrier in decreasing order of their mass to charge ratio by progressively increasing the amplitude of the one or more transient DC voltage or potentials which is applied to the electrodes of the ion guide and/or by decreasing the effective amplitude of the pseudo-potential barrier. The amplitude of the pseudo-potential barrier may be decreased by reducing the amplitude of the applied RF voltage and/or by increasing the frequency of the applied RF voltage.

According to another embodiment the pseudo-potential barrier may be augmented by an additional DC potential applied to electrodes in proximity to the pseudo-potential barrier. According to this embodiment the amplitude of the barrier is a combination of a mass to charge ratio dependent pseudo-potential barrier and a mass to charge ratio independent DC potential barrier. The amplitude of the effective barrier may be decreased by reducing the amplitude of the RF voltage and/or by increasing the applied frequency of the applied RF voltage and/or by reducing the amplitude of the applied DC potential. Ions, which are mass selectively ejected from the ion guide in an axial manner may be transmitted onwardly for further processing and/or analysis.

According to another embodiment the pseudo-potential barrier may be arranged at the entrance of the ion guide such that if ions having a particular mass to charge ratio have sufficient axial energy then they will overcome the pseudo-potential barrier and so enter the preferred ion guide. If ions having a particular mass to charge ratio have insufficient axial energy to overcome the pseudo-potential barrier then they are preferably prevented from entering the ion guide and hence are lost to the system. The preferred ion guide may be used to affect a low-mass cut off characteristic. The characteristics of this low-mass cut off may be altered by increasing the amplitude of the mass to charge ratio dependent barrier and/or by increasing the axial energy of the ions entering the ion guide.

According to a particularly preferred embodiment a first AC or RF voltage may be applied to the electrodes so that axially adjacent electrodes are maintained at opposite phases of the first AC or RF voltage. The polarity of a pair of electrodes may then be switched or reversed. At an instance in time the polarity of a plurality of electrodes may therefore be changed from +−+−+−+− to +−++−−+−. As a result the effective thickness of electrodes along a portion or section of the ion guide is effectively increased.

Further embodiments are contemplated wherein a multi-phase RF voltage may be applied to the electrodes. For example, a three phase RF voltage may be applied wherein a 120° phase difference is maintained initially between adjacent electrodes. A pseudo-potential barrier may be created by altering the phase relationship between electrodes or of a number of electrodes in a region or section of the ion guide or mass analyser. For example, the phase relationship or pattern along a section of the ion guide or mass analyser may be changed from: 123 123 123 123 123 to being: 123 331 112 223 123. Again, according to this embodiment the effective thickness of electrodes along a portion or section of the ion guide or mass analyser is effectively increased. A pseudo-potential barrier will therefore created at this region which has an amplitude which is greater than the amplitude of the pseudo-potential corrugations which are otherwise formed along the length of the ion guide.

According to an aspect of the present invention there is provided an ion guide or mass analyser comprising:

a plurality of electrodes;

means for applying a n-phase AC or RF voltage to the plurality of electrodes wherein n≥2;

means for maintaining a first phase relationship or first aspect ratio between, at or of the plurality of electrodes; and means for changing the phase relationship or aspect-ratio between, at or of a sub-set of the plurality of electrodes so that a second different phase relationship or second aspect ratio is maintained between, at or of the sub-set of electrodes so as to create, in use, one or more axial time averaged or pseudo-potential barriers, corrugations or wells along at least a portion of the axial length of the ion guide or mass analyser.

Preferably, n is selected from the group consisting of: (i) 2; (ii) 3; (iii) 4; (iv) b; (v) 6; (vi) 7; (vii) 8; (viii) 9; (ix) 10; and (x) >10.

The first phase relationship or first aspect ratio preferably has a first periodicity, pattern, sequence or value and the second phase relationship or second aspect ratio preferably has a second different periodicity, pattern, sequence or value.

According to an aspect of the present invention there is provided a method of guiding ions or mass analysing ions comprising:

providing an ion guide or mass analyser comprising a plurality of electrodes;

applying a n-phase AC or RF voltage to the plurality of electrodes wherein n≥2;

maintaining a first phase relationship or first aspect ratio between the plurality of: electrodes; and changing the phase relationship or first aspect ratio between, at or of a sub-set of the plurality of electrodes so that a second different phase relationship or second aspect ratio is maintained between, at or of the sub-set of electrodes so as to create one or more axial time average or pseudo-potential barriers, corrugations or wells along at least a portion of the axial length of the ion guide or mass analyser.

According to another aspect of the present invention there is provided an ion guide or mass analyser comprising;

a plurality of electrodes;

means for applying a n-phase AC or RF voltage to the plurality of electrodes wherein n≥2; and means for scanning the phase or aspect ratio of one or more of the plurality of electrodes so as to create, in use, one or more axial time averaged or pseudo-potential barriers, corrugations or wells along at least a portion of the axial length of the ion guide or mass analyser.

According to another aspect of the present invention there is provided a method of guiding ions or mass analysing ions comprising:

providing an ion guide or mass analyser comprising a plurality of electrodes;

applying a n-phase AC or RF voltage to the plurality of electrodes wherein n≥2; and scanning the phase or aspect ratio of one or more of the plurality of electrodes so as to create, in use, one or more axial time averaged or pseudo-potential barriers, corrugations or wells along at least a portion of the axial length of the ion guide or mass analyser.

According to this embodiment the phase of one or more electrodes may be progressively varied or scanned. The phase of the one or more electrodes may be scanned by at least θ°, wherein θ is selected from the group consisting of: (i) <10; (ii) 10-20; (iii) 20-30; (iv) 30-40; (v) 40-50; (vi) 50-60; (vii) 60-70; (viii) 70-80; (ix) 80-90; (x) 90; (xi) 90-100; (xii) 100-110; (xiii) 110-120; (xiv) 120-130; (xv) 130-140; (xvi) 140-150; (xvii) 150-160; (xviii) 160-170; (xix) 170-180; and (xx) 180. As the phase of the one or more electrodes is progressively varied or scanned then the height of the one or more axial time averaged or pseudo-potential barriers, corrugations or wells preferably increases or decreases.

According to the preferred embodiment ions near the centre of the stacked ring ion guide will have stable trajectories for a wide range of conditions. This is in contrast, to the radial stability conditions for ions in a quadrupole rod set wherein changing the nature of the oscillating field along the axis of such a device may cause undesired radial instabilities and/or resonances resulting in losses of ions.

Multi-pole rod sets are also relatively large and expensive to manufacture compared to the barrier device or mass analyser according to the preferred embodiment. The ion guide or mass analyser according to the preferred embodiment is therefore particularly advantageous compared with known arrangements.

BRIEF DESCRIPTION OF THE DRAWINGS

Various embodiments of the present invention will now be described, by way of example only, and with reference to the accompanying drawings in which.

DETAILED DESCRIPTION OP THE PREFERRED EMBODIMENTS

An embodiment of the present invention will now be described with reference to FIG. 1. According to this embodiment a RF ring stack ion guide 2 is provided. The ion guide preferably comprises an entrance plate or electrode 1 which is preferably held or maintained in use at a DC potential and a plurality of other annular electrodes or plates 2*a*. Opposite phases of a modulated (RF) potential are preferably applied to alternate electrodes or plates 2*a* which form the ion guide. The ion guide 2 preferably comprises an exit plate or electrode 3 which is preferably held or maintained in use at a DC potential.

According to the preferred embodiment an additional, transient DC potential 4 is preferably applied to one or more of the ring electrodes 2*a* as shown. The transient DC potential 4 is preferably applied to one or more electrodes 2*a* at the same time for a relatively short period of time. The DC potential 4 is then preferably switched or applied to one or more adjacent or subsequent electrodes 2*a*. According to the preferred embodiment one or more transient DC potentials or voltages or one or more transient DC voltage or potential waveforms are preferably progressively applied to some or all of the electrodes 2*a* of the ion guide 2 in order to urge ions in a particular direction along the length of the ion guide 2.

Figure 2:
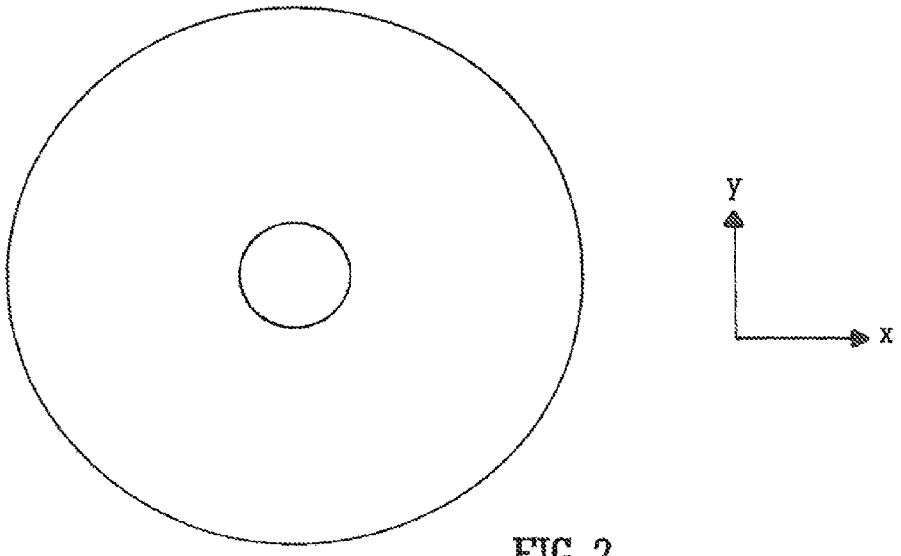
FIG. 2 shows a stacked ring ion guide in the x,y plane according to an embodiment of the present invention.

The ion guide 2 preferably comprises a series of annular electrodes 2*a* which preferably have an internal diameter of 5 mm. FIG. 2 shows the stacked ring ion guide 2 when viewed in the x,y plane. Each electrode 2*a* is preferably 0.5 mm thick and the centre-to-centre spacing between adjacent electrodes is preferably 1.5 mm. The diameter of the aperture of the entrance and exit electrode 1,3 is preferably 2 mm.

Figure 3A:
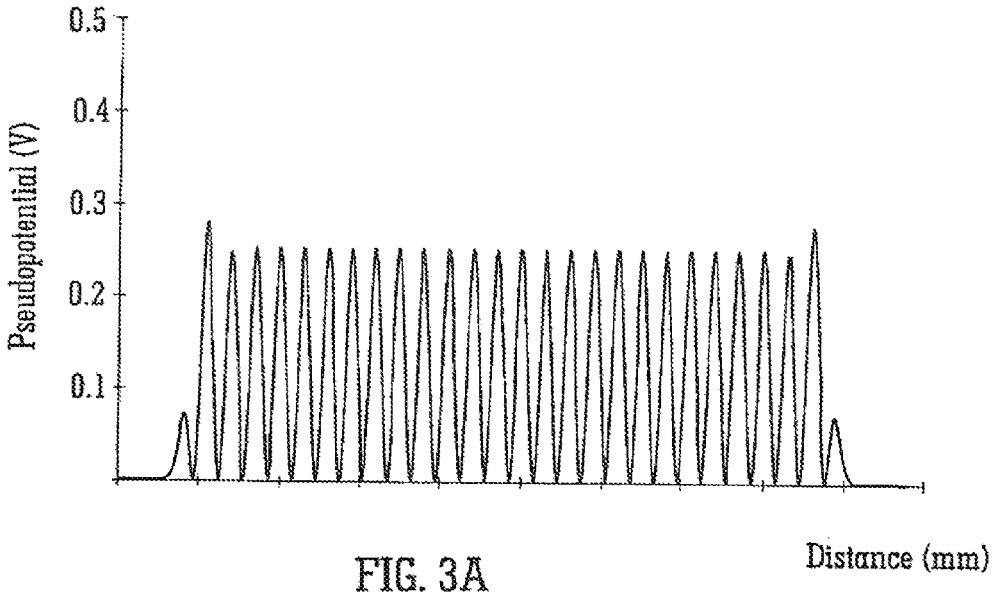
FIG. 3A shows a plot of the axial pseudo-potential along the central axis of an ion guide experienced by ions having a mass to charge ratio of 100 and FIG. 3B shows a plot of the axial pseudo-potential along the central axis of an ion guide experienced by ions having a mass to charge ratio of 500.
Figure 3B:
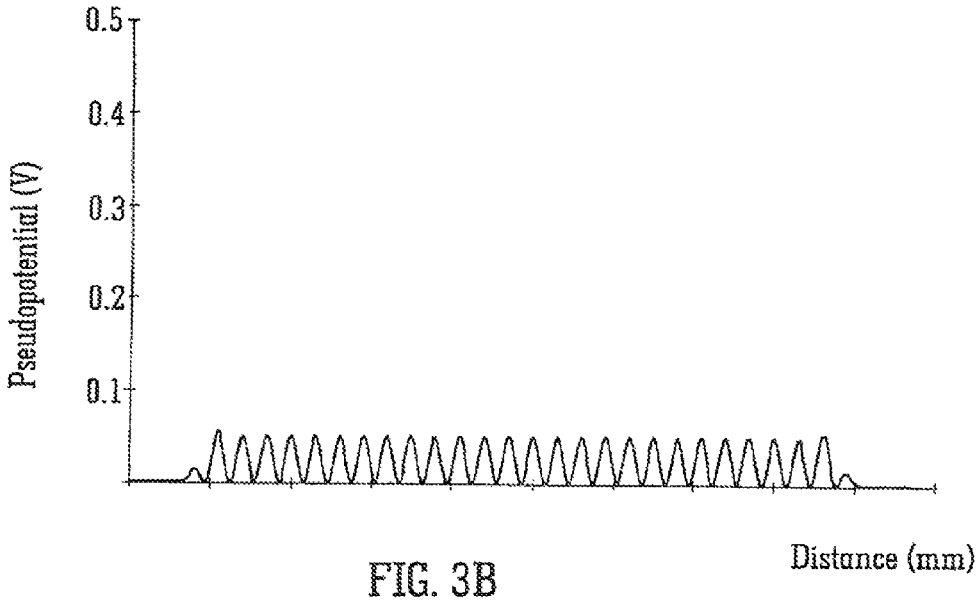

FIG. 3A shows a plot of the time averaged or pseudo-potential along the central axis of the ion guide 2 as experienced by ions having a mass to charge ratio of 100 when a RF voltage having a maximum voltage of 100 V at a frequency of 1 MHz is applied to the ion guide 2. FIG. 3B shows a comparable plot of the time averaged or pseudo-potential along the central axis of the ion guide 2 as experienced by ions having a mass to charge ratio of 500.

Figure 1:
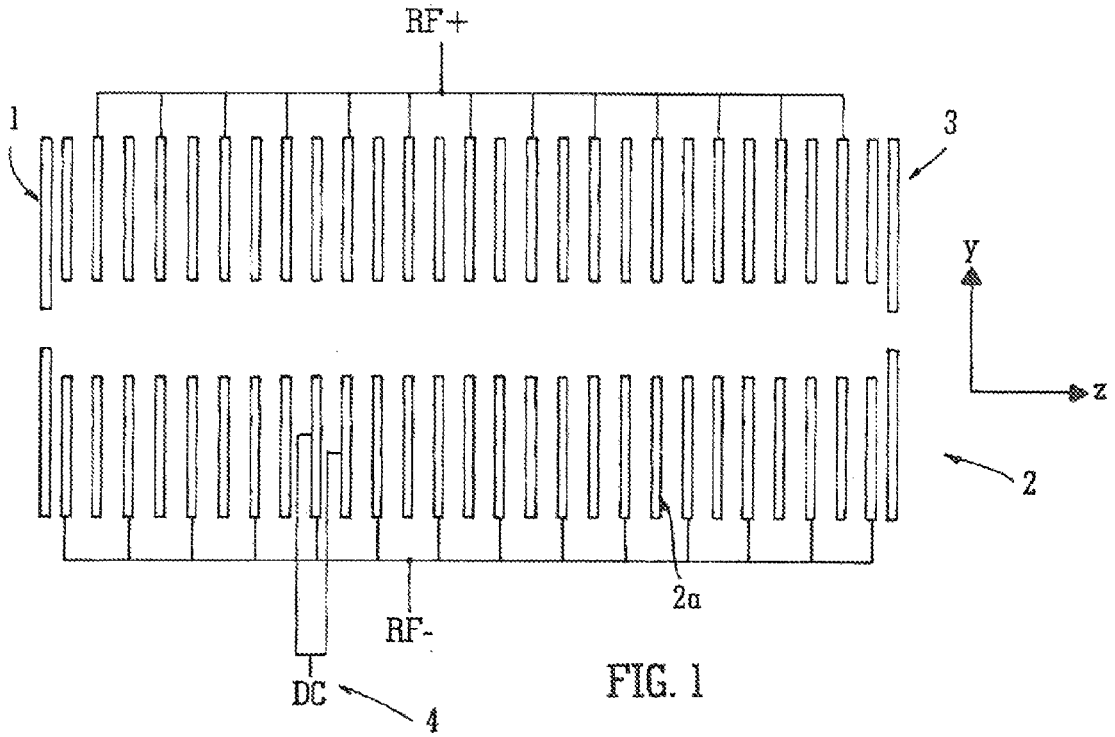
FIG. 1 shows a stacked ring ion guide in the y,z plane according to an embodiment of the present invention.

The plots shown in FIGS. 3A and 3B were obtained by recording the voltage gradient within a three dimensional computer simulation (SIMION) of an ion guide having a geometry as shown in FIG. 1. A static DC voltage was applied to each of the lens elements equivalent to the maximum voltage during a frequency cycle. The pseudo-potentials were then calculated directly from the recorded field using the equation:

$$V^* = \frac{qE^2}{4m\Omega^2} \tag{1}$$

wherein q is the total charge on the ion (z.e), e is the electron charge, z is the number of charges, m is the atomic mass of the ion, Ω is the frequency of the modulated potential and E is the electric field recorded.

Figure 4:
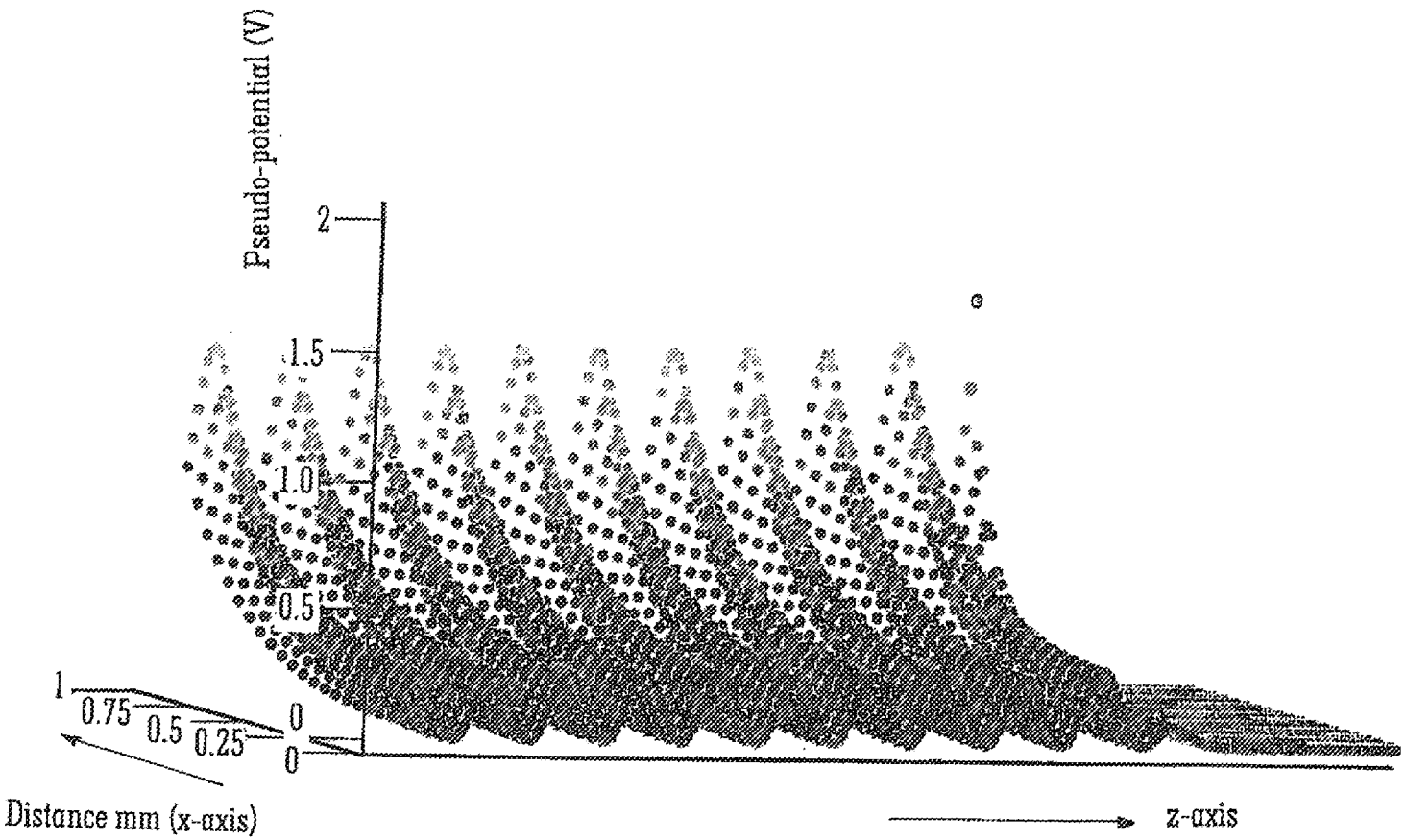
FIG. 4 shows a three-dimensional plot of the axial and radial pseudo-potential for the embodiment shown in FIG. 3A and experienced by ions having a mass to charge ratio of 100.

FIG. 4 shows the radial and axial pseudo-potential within a preferred ion guide 2 cut along the centre of the z-axis for a region at the exit of the ion guide 2 and extending from 0 to 1 mm in the x-axis (radial direction). The conditions of voltage and frequency are as previously described for ions having a mass to charge ratio of 100.

It can be seen from FIGS. 3A and 3B that the axial pseudo-potential corrugations in the z axis are larger for ions having a relatively low mass to charge ratio than for ions having a relatively high mass to charge ratio. As is apparent from FIG. 4, along the central axis the axial pseudo-potential corrugations have a relatively low amplitude compared with the amplitude of the pseudo-potential corrugations at a radial displacement away from the central axis. Ions may be propelled readily along the ion guide 2 by applying one or more transient DC voltages or potentials or one or more transient DC voltage or potential waveforms to the electrodes 2*a* of the ion guide 2.

Figure 5:
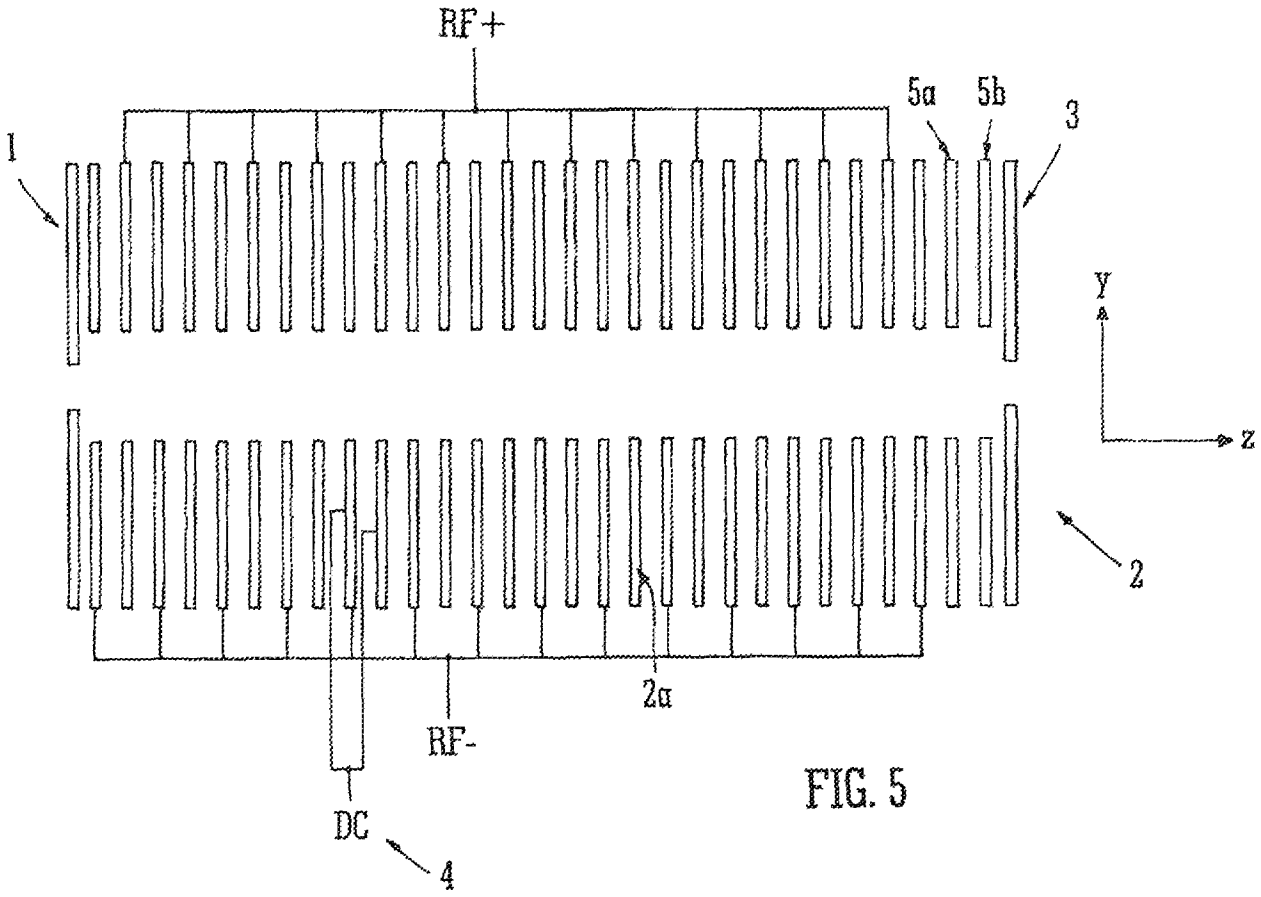
FIG. 5 shows an embodiment of the present invention wherein a mass to charge ratio dependant barrier is provided at the exit of the preferred ion guide or mass analyser.

FIG. 5 shows an embodiment of the present invention wherein the last two annular plates or electrodes 5*a*,5*b* immediately prior to or upstream of the exit aperture 3 are preferably driven by a second RF voltage supply which is preferably different to the first RF voltage supply which is preferably applied to the preceding annular plates or electrodes 2*a*.

When the amplitude of the second RF voltage which is preferably applied to one or both of the last two annular plates or electrodes 5*a*,5*b* is increased with respect to the amplitude of the first RF voltage applied to the other plates or electrodes 2*a*, then the depth of the pseudo-potential corrugations and hence the height of the pseudo-potential barrier at the exit of the ion tunnel ion guide or mass analyser 2 is preferably increased.

According to another embodiment the frequency of the second RF modulation applied to one or both of the last two annular plates or electrodes 5*a*,5*b* may be decreased with respect to the frequency of modulation of the first RF voltage applied to the other electrodes 2*a* of the ion guide or mass analyser 2.

Figure 6A:
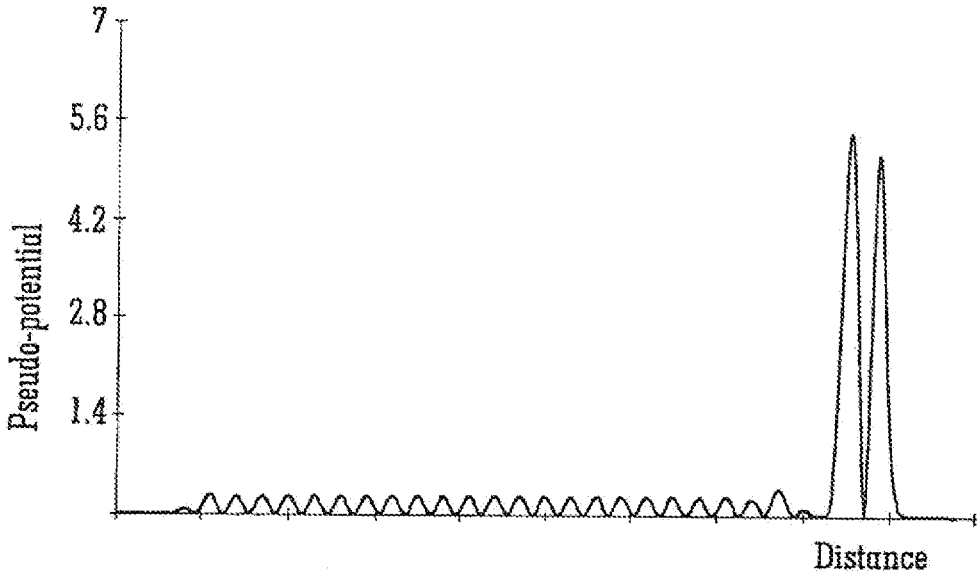
FIG. 6A shows a plot of the axial pseudo-potential along the centre line of the ion guide or mass analyser as a function of distance for an ion guide or mass analyser as shown in FIG. 5 and as experienced by ions having a mass to charge ratio of 100 and FIG. 6B shows a plot of the axial pseudo-potential along the centre line of the ion guide or mass analyser as a function of distance for the ion guide or mass analyser shown in FIG. 5 and as experienced by ions having a mass to charge ratio of 500.
Figure 6B:
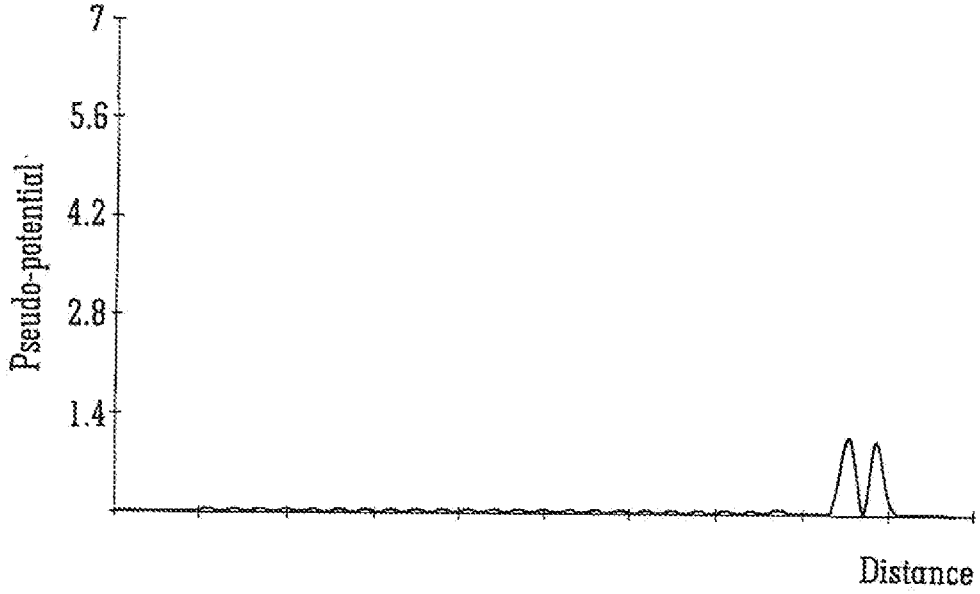

FIG. 6A shows a plot of the time averaged or pseudo-potential along the central axis of an ion guide or mass analyser 2 as experienced by ions having a mass to charge ratio of 100 when a first RF voltage having a maximum amplitude of 100 V and a frequency of 1 MHz is applied to annular plates or electrodes 2*a*, an RF voltage having a maximum amplitude of 400 V is applied to plate 5*b* (which is arranged immediately upstream of exit electrode 3) and a third RF voltage having a maximum amplitude of 200 V is applied to plate 5*a* (which is arranged upstream of electrode 5*b*). The phase and frequency of the modulated potential applied to all the plates or electrodes 2*a*,5*a*,5*b* was identical. FIG. 6B shows the time averaged or pseudo-potential along the central axis of the ion guide or mass analyser 2 as experienced by ions having a higher mass to charge ratio of 500.

Figure 7:
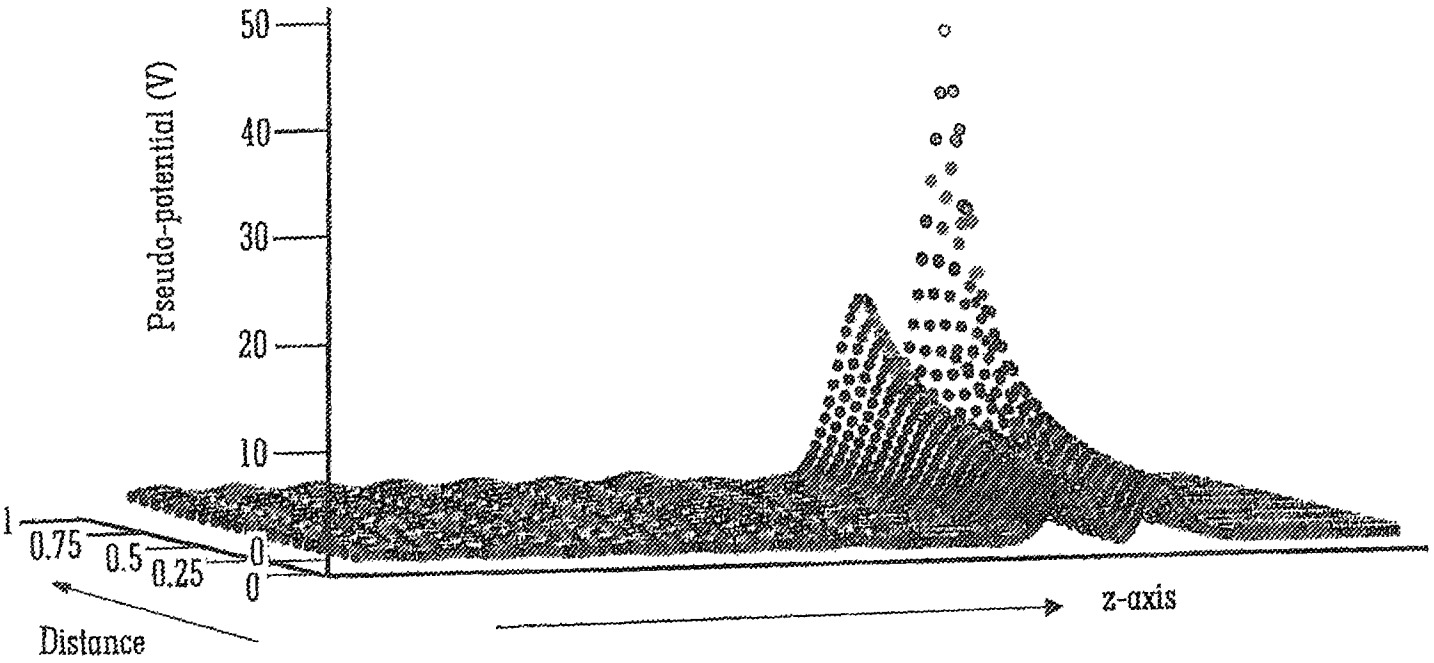
FIG. 7 shows a three-dimensional plot of the axial and radial pseudo-potential for the embodiment shown in FIG. 6A and as experienced by ions having a mass to charge ratio of 100.

FIG. 7 shows the radial and axial pseudo-potential within the preferred ion guide or mass analyser 2 cut along the centre of the z-axis for a region at the exit of the ion guide or mass analyser 2 and extending from 0 to 1 mm in the x-axis (radial direction). The conditions of voltage and frequency are as previously described with regard to FIG. 6A for ions having a mass to charge ratio of 100.

The result of increasing the amplitude of the modulated potential at the exit of the ion guide or mass analyser 2 is to produce a pseudo-potential barrier which preferably has am amplitude which is inversely proportional to the mass to charge ratio of ions.

According to the preferred embodiment ions are preferably introduced into the ion guide from an external ion source. The ions may be introduced, for example, either in a pulsed, manner or in a continuous manner at a time $T_0$. As ions are introduced, the axial energy of the ions entering the ion guide or mass analyser 2 is preferably arranged such that all ions having mass to charge ratios within a specific range are confined by the radial RF field and are preferably prevented from exiting the ion guide or mass analyser 2 due to the presence of the pseudo-potential barrier.

The initial energy spread of ions confined within the ion guide or mass analyser 2 may be reduced by introducing a cooling gas into an ion confinement region of the ion guide or mass analyser 2. The ion guide or mass analyser 2 is preferably maintained at a pressure in the range $10^{-5}$-$10^{1}$ mbar or more preferably in the range $10^{-3}$-$10^{-1}$ mbar. The kinetic energy of the ions will preferably be reduced as a result of collisions between ions with gas molecules. Ions will therefore cool to thermal energies.

Once ions have been accumulated within the ion guide or mass analyser 2 a DC voltage applied to the entrance electrode 1 may be raised in order to prevent ions from exiting the ion guide or mass analyser 2 via the entrance.

According to another embodiment one or more pseudo-potential barriers may be formed at the entrance of the ion guide or mass analyser 2 by applying one or more suitable potentials to one or more annular plates or electrodes arranged at the entrance of the ion guide or mass analyser 2.

At an initial time $T_0$ one or more transient DC voltages or potentials or one or more DC voltage or potential waveforms are preferably applied to the electrodes 2*a* forming the ion guide or mass analyser 2. According to an embodiment the amplitude of the one or more DC voltages or potentials or one or more DC voltage or potential waveforms may be relatively low or effectively zero initially. The amplitude of the one or more transient DC voltages or potentials or one or more DC voltage or potential waveforms may then according to one embodiment be progressively ramped, stepped up or increased in amplitude to a final maximum value. Ions are thus preferably propelled, urged or translated towards a pseudo-potential barrier arranged at the exit of the ion guide or mass analyser 2. Ions are preferably caused to exit the ion guide or mass analyser 2 in reverse order of their mass to charge ratio with ions having relatively high mass to charge ratios exiting the ion guide or mass analyser 2 before ions having relatively low mass to charge ratios. The process may then be repeated once the ion guide or mass analyser 2 has been emptied of ions.

Figure 8:
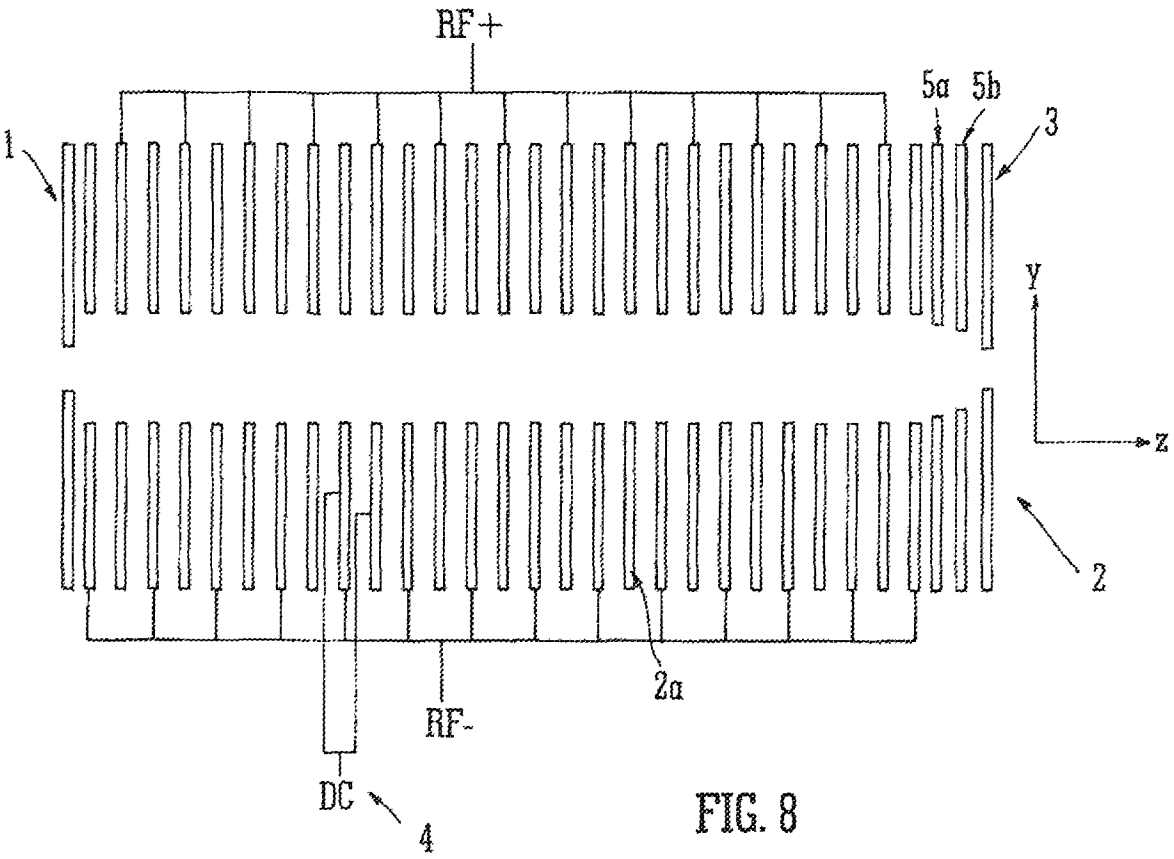
FIG. 8 shows another embodiment of the present invention wherein a mass to charge ratio dependant barrier is formed at the exit of the ion guide or mass analyser and wherein the exit, electrodes are arranged to have relatively small apertures.

FIG. 8 shows an embodiment wherein the diameter of the two annular plates or electrodes 5*a*,5*b* arranged at the exit of the ion guide or mass analyser 2 are preferably smaller than the diameter of the electrodes 2*a* comprising the rest of the ion guide or mass analyser 2. A mass selective pseudo-potential barrier is preferably formed at the exit of the ion guide or mass analyser 2 in a similar manner to the embodiment described above in relation to FIG. 5. The embodiment shown in FIG. 8 preferably has the advantage that the amplitude of the modulated RF potential required to produce a similar amplitude mass dependent pseudo-potential barrier is less than for the embodiment shown in FIG. 5.

Figure 9:
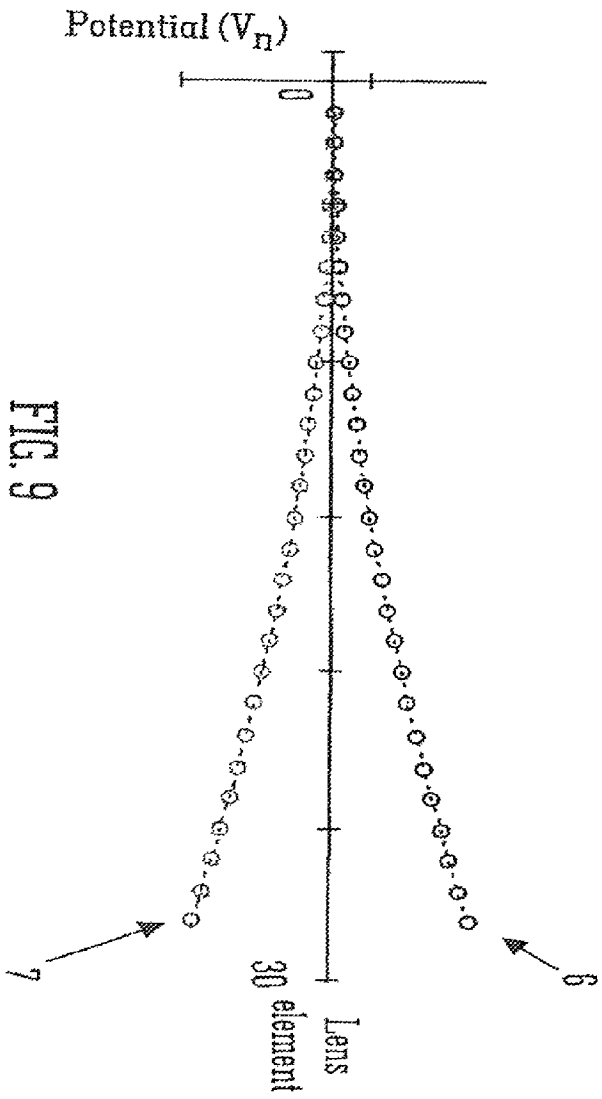
FIG. 9 shows the maximum and minimum potential of an additional time varying potential which is applied to the electrodes.

A less preferred method of producing a mass to charge ratio dependent pseudo-potential harrier within an ion guide or mass analyser 2 will foe described with reference to FIGS. 1 and 9. The ion guide or mass analyser 2 is preferably similar to the ion guide or mass analyser 2 shown, in FIG. 1. However, the amplitude of the applied RF voltage, or an additional RF or AC voltage, which is preferably applied to the ring electrodes 2*a* is preferably arranged to progressively increase towards the exit of the ion guide or mass analyser 2 or along the length of the ion guide or mass analyser 2. FIG. 9 shows a plot of the maximum amplitude 6 and the minimum amplitude 7 of the additional modulated voltages as a function of the number of the lens element of the ion guide or mass analyser 2 as shown in FIG. 1.

The general form of the additional time varying potentials $V_n$ applied to a lens element n may be described by:

$$V_n = f(n)\cos(\sigma t) \tag{2}$$

wherein n is the index number of the lens element, f(n) is the function describing the amplitude of the oscillation for element n and σ is the frequency of modulation.

If the maximum amplitude of an additional modulated potential described by f(n) increases towards the exit of the ion guide or mass analyser 2 in a non-linear function as shown in FIG. 9, then a mass to charge ratio dependent pseudo-potential barrier will preferably be formed at the exit of the ion guide or mass analyser 2 which is superimposed over the or any axial pseudo-potential corrugations which are formed as a result of the alternating phases of AC or RF voltage which are preferably applied to consecutive ring electrodes 2*a*.

According to another embodiment one or more mass selective pseudo-potential barriers may be developed or created by changing the aspect ratio between the inner diameter of the ring electrodes 2*a* and the spacing between adjacent, ring electrodes within or along a specific region or portion of the ion guide or mass analyser 2. The change in aspect ratio may be effected by altering the mechanical design of the ring electrodes 2*a* and/or by changing the phase or phase relationship between a series of two or more neighbouring ring electrodes. For example, if two neighbouring ring electrodes are switched to be supplied with the same phase of a modulated potential (as opposed to opposite phases of modulated potential), then the aspect ratio in this region or section of the ion guide or mass analyser 2 will, in effect, also be modified. According to one embodiment the polarity or phase of a pair of electrodes may be switched or reversed, so that the effective aspect ratio of a region or section of the ion guide or mass analyser 2 is varied with respect, to the aspect ratio as maintained along the rest of the ion guide or mass analyser 2. The aspect ratio and thus the height of the pseudo-potential barrier may according to an embodiment be continuously or otherwise adjusted by continuously or otherwise adjusting the phase difference between neighbouring electrodes or groups of electrodes from, for example, 180 degrees to 0 degrees. These methods may be used in conjunction with the approach of varying the amplitude and/or the frequency of the applied modulated potential.

Figure 10:
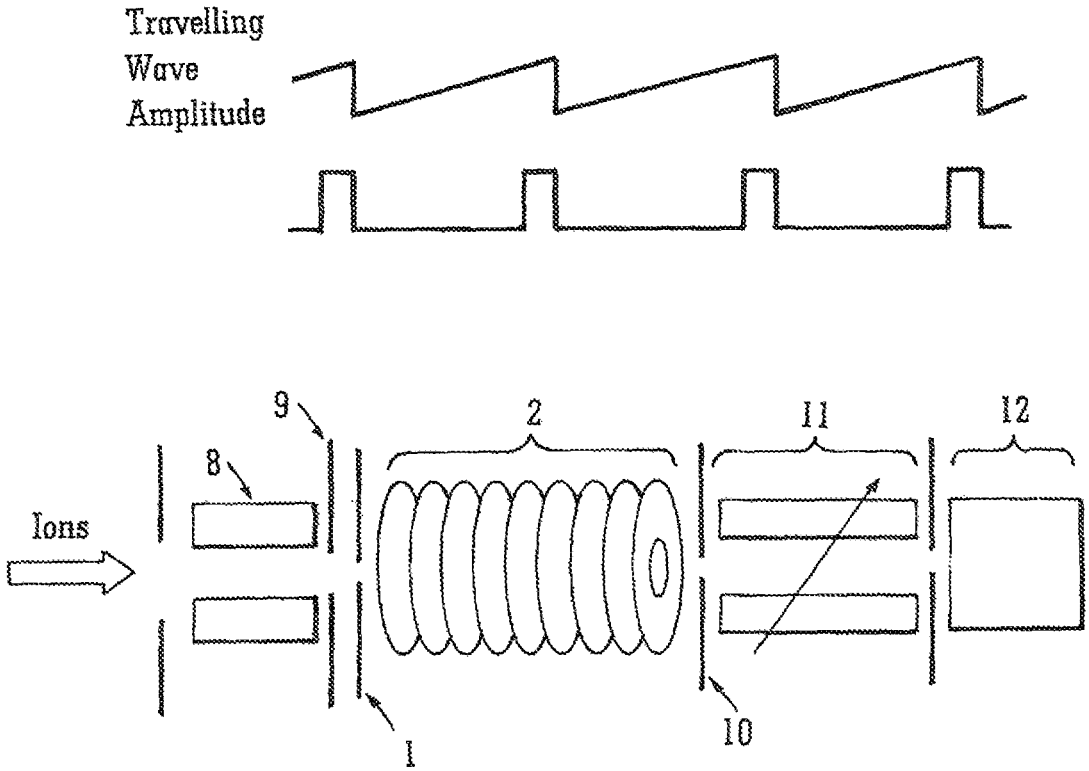
FIG. 10 shows an embodiment wherein a preferred ion guide or mass analyser is coupled with a quadrupole rod set mass analyser which is scanned in use.

FIG. 10 shows an embodiment of the present invention wherein a preferred ion guide or mass analyser 2 is coupled in series with a higher resolution mass analyser 11, such as a quadrupole mass filter. This enables a mass spectrometer to be provided having an overall improved duty cycle and sensitivity. Ions from an ion source are preferably accumulated in an ion trap 8 which is preferably located upstream of a preferred ion guide or mass analyser 2. Ions are then preferably periodically released from the ion trap 8 by pulsing a gate electrode 9 provided at the exit of the ion trap 8. The ions which are released or pulsed out from the ion trap 8 are then preferably directed to enter the preferred ion guide or mass analyser 2. The ions preferably remain axially confined within the preferred ion guide or mass analyser 2 due to the presence of a pseudo-potential barrier formed at the exit of the preferred ion guide or mass analyser 2. A DC barrier voltage is preferably applied to an entrance electrode 1 of the preferred ion guide or mass analyser 2 once ions have entered the preferred ion guide or mass analyser 2. This preferably prevents ions from exiting the preferred ion guide or mass analyser 2 upstream via the aperture in the entrance electrode 1. Once ions have been accumulated within the preferred ion guide or mass analyser 2 then one or more transient DC voltages or potentials or one or more transient DC voltage or potential waveforms are preferably superimposed on the electrodes forming the ion guide or mass analyser 2 in order to drive or urge ions towards the exit of the preferred ion guide or mass analyser 2.

The amplitude of the one or more transient DC voltages or potentials or the one or more transient DC voltage or potential waveforms is preferably progressively increased with time to a final maximum voltage. Ions are preferably urged, driven or pushed over the pseudo-potential barrier which is preferably arranged at the exit of the preferred ion-guide or mass analyser 2 in decreasing order of their mass to charge ratio. The output of the preferred ion guide or mass analyser 2 is preferably a function of the mass to charge ratio of ions and time.

Initially, ions having a relatively high mass to charge ratio will preferably exit the preferred ion guide or mass analyser 2. Ions having progressively lower mass to charge ratios will then preferably subsequently exit the ion guide or mass analyser 2. Ions having a particular mass to charge ratio will preferably exit the ion guide or mass analyser 2 over a relatively short or narrow period of time. According to an embodiment the mass to charge ratio transmission window of a scanning quadrupole mass filter/analyser 11 arranged downstream of the preferred ion guide or mass analyser 2 is preferably synchronised with the mass to charge ratio of the ions exiting the ion guide or mass analyser 2. As a result, the duty cycle of the scanning quadrupole mass analyser 11 is preferably increased. An ion detector 12 is preferably arranged downstream of the quadrupole mass analyser 11 to detect ions.

According to another embodiment the mass to charge ratio transmission window of the quadrupole mass filter 11 may be increased in a stepped or other manner which is preferably substantially synchronised with the mass to charge ratios of the ions exiting the ion guide or mass analyser 2. According to this embodiment, the transmission efficiency and the duty-cycle of the quadrupole mass filter 11 may be increased in a mode of operation wherein only ions having specific masses or mass to charge ratios are desired to be measured or analysed.

Figure 11:
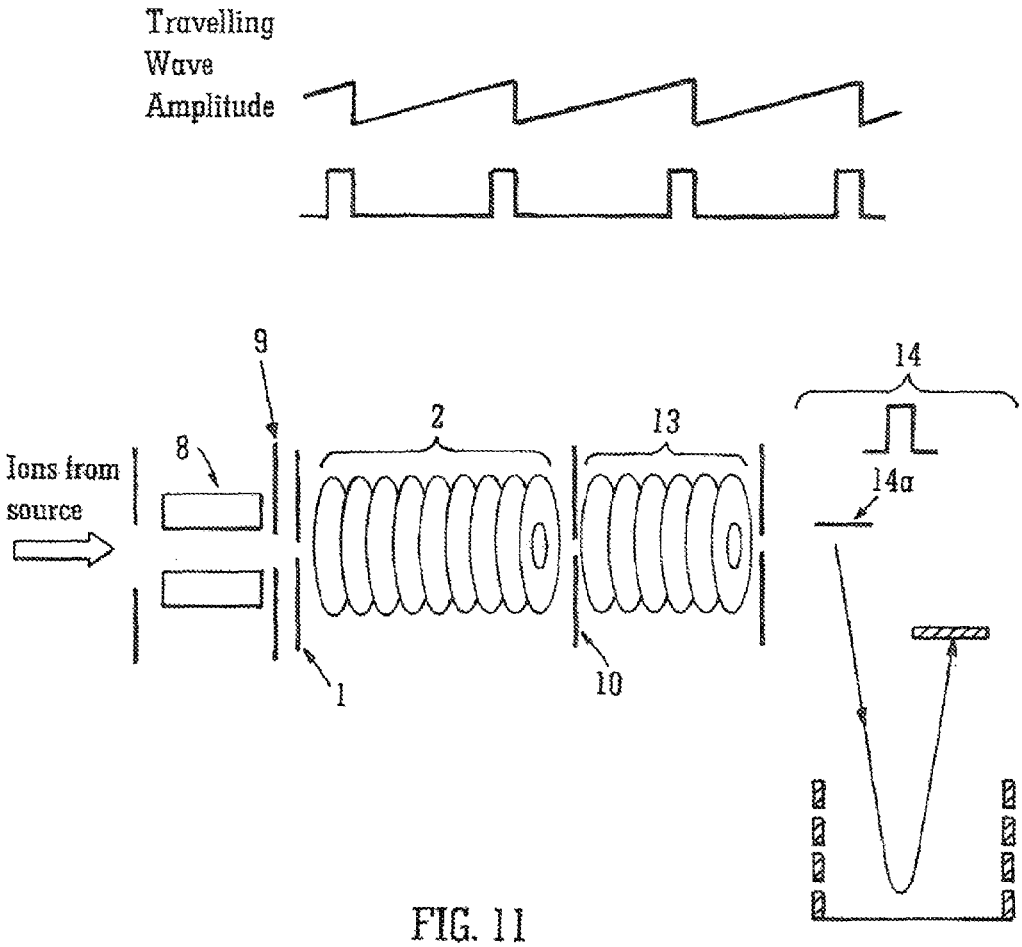
FIG. 11 shows an embodiment wherein a preferred ion guide or mass analyser is coupled to an orthogonal acceleration Time of Flight mass analyser.

According to another embodiment a preferred ion guide or mass analyser 2 may be coupled to an orthogonal acceleration Time of Flight mass analyser 4 as shown in FIG. 11. The preferred ion guide or mass analyser 2 is preferably coupled to the Time of Flight mass analyser 14 via a further ion guide 13. One or more transient DC voltages or potentials or one or more transient DC voltage or potential waveforms are preferably applied to the electrodes of the further ion guide 13 in order to transmit ions received from the preferred ion guide or mass analyser 2 and to transmit the ions in a manner which preferably maintains the order in which the ions were received. The ions are therefore preferably onwardly transmitted to the Time of Flight mass analyser 14 in an optimal, manner. The combination of the preferred ion guide or mass analyser 2 and the Time of Flight mass analyser 14 preferably results in an overall mass spectrometer having an improved duty cycle and sensitivity. The ions output from the preferred ion guide or mass analyser 2 at any particular instance preferably have a well defined mass to charge ratio.

The further ion guide 13 preferably partitions the ions emerging or received from the ion guide or mass analyser 2 into a number of discrete packets of ions. Each packet of ions received by the further ion guide 13 is preferably trapped, within separate axial potential walls which are preferably continuously translated along the length of the further ion guide 13. Each axial potential well therefore preferably comprises ions having a restricted range of mass to charge ratios. The axial potential wells are preferably continually transported along the length of the further ion guide 13 until the ions are released towards or into the orthogonal acceleration Time of Flight mass analyser 14. An orthogonal acceleration pulse is preferably synchronised with the arrival of ions from the further ion guide 13 so as to maximise the transmission of the ions (which preferably have a restricted range of mass to charge ratios) present within, each packet or well into the orthogonal acceleration Time of Flight mass analyser 14.

According to another embodiment a pseudo-potential barrier may be positioned at the entrance to the preferred ion guide or mass analyser 2. Accordingly, if ions having a particular mass to charge ratio have enough initial axial energy to overcome the pseudo-potential barrier then the ions will then enter the preferred ion guide or mass analyser 2. However, if ions having a particular mass to charge ratio have insufficient initial axial energy to overcome the pseudo-potential barrier then they are preferably prevented from entering the ion guide or mass analyser 2 and may be lost to the system. According to this embodiment the ion guide or mass analyser 2 may be operated so as to have a low mass or mass to charge ratio cut off. The characteristics of the low mass or mass to charge ratio cut off may be altered or varied as a function of time, by increasing or varying the amplitude of the mass to charge ratio dependent barrier or by increasing or varying the initial axial energy of the ions entering the preferred ion guide or mass analyser 2. The magnitude of the pseudo-potential barrier may be increased by increasing the RF voltage and/or by decreasing the frequency of the RF voltage applied to the electrodes.

Figure 12:
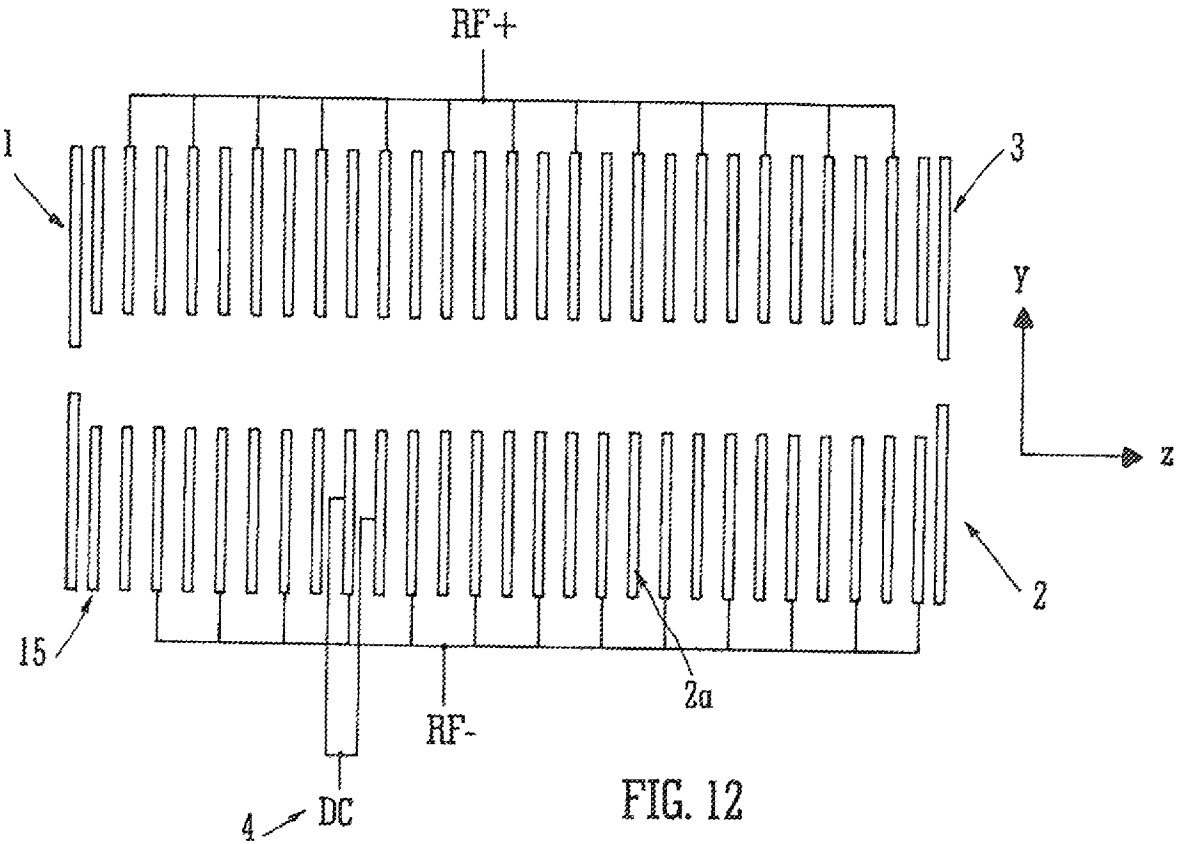
FIG. 12 shows an embodiment wherein a mass to charge ratio dependant barrier is formed at the entrance of a preferred ion guide or mass analyser.

FIG. 12 shows a further embodiment wherein the first annular plate or electrode 15 immediately after or downstream of the entrance electrode 1 is preferably driven by an RF voltage supply which is preferably separate or different to the RF supply which is preferably applied to the other annular plates or electrodes 2*a* which preferably form or comprise the ion guide or mass analyser 2. When the amplitude of the RF voltage applied to the first annular plate or electrode 15 is increased with respect to the amplitude of the RF voltage applied, to the other annular plates or electrodes 2*a* then the height of the pseudo-potential barrier at the entrance of the preferred ion guide or mass analyser 2 is preferably increased. A similar effect may be achieved by decreasing the frequency of the RF modulation applied to the first annular plate or electrode 15 with respect to the frequency of modulation of the potential applied to the other electrodes 2*a* of the ion guide or mass analyser 2.

Figure 13A:
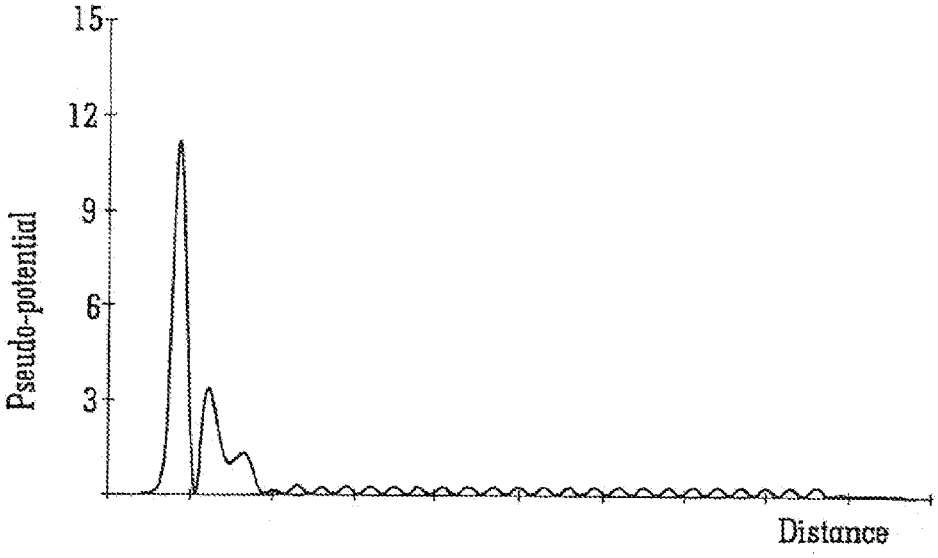
FIG. 13A shows a plot of the axial pseudo-potential along the centre line of the ion guide or mass analyser as a function of distance for an ion guide or mass analyser as shown in FIG. 12 and as experienced by ions having a mass to charge ratio of 100 and FIG. 13B shows a plot of the axial pseudo-potential along the centre line of the ion guide as a function of distance for an ion guide or mass analyser as shown in FIG. 12 and as experienced by ions having a mass to charge ratio of 500.
Figure 13B:
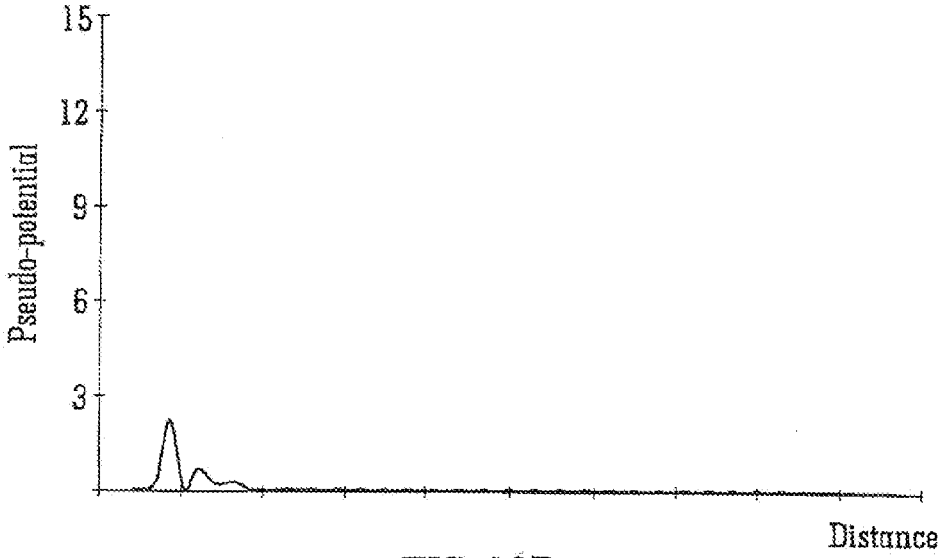

FIG. 13A shows a plot of the time averaged potential or pseudo-potential along the central axis of the preferred ion guide or mass analyser 2 shown in FIG. 12 as experienced by ions having a mass to charge ratio of 100 when an RF voltage having a maximum of 100 V at a frequency of 1 MHz was applied to the annular plates or electrodes 2*a*. The maximum amplitude of the modulated potential applied to the first annular plate or electrode 15 was 400 V. The phase and frequency of the modulated potential applied to all the annular plates or electrodes 2*a*,15 was identical. FIG. 13B shows the corresponding time averaged potential or pseudo-potential along the central axis of the ion guide or mass analyser 2 as experienced by ions having a mass to charge ratio of 500.

Figure 14:
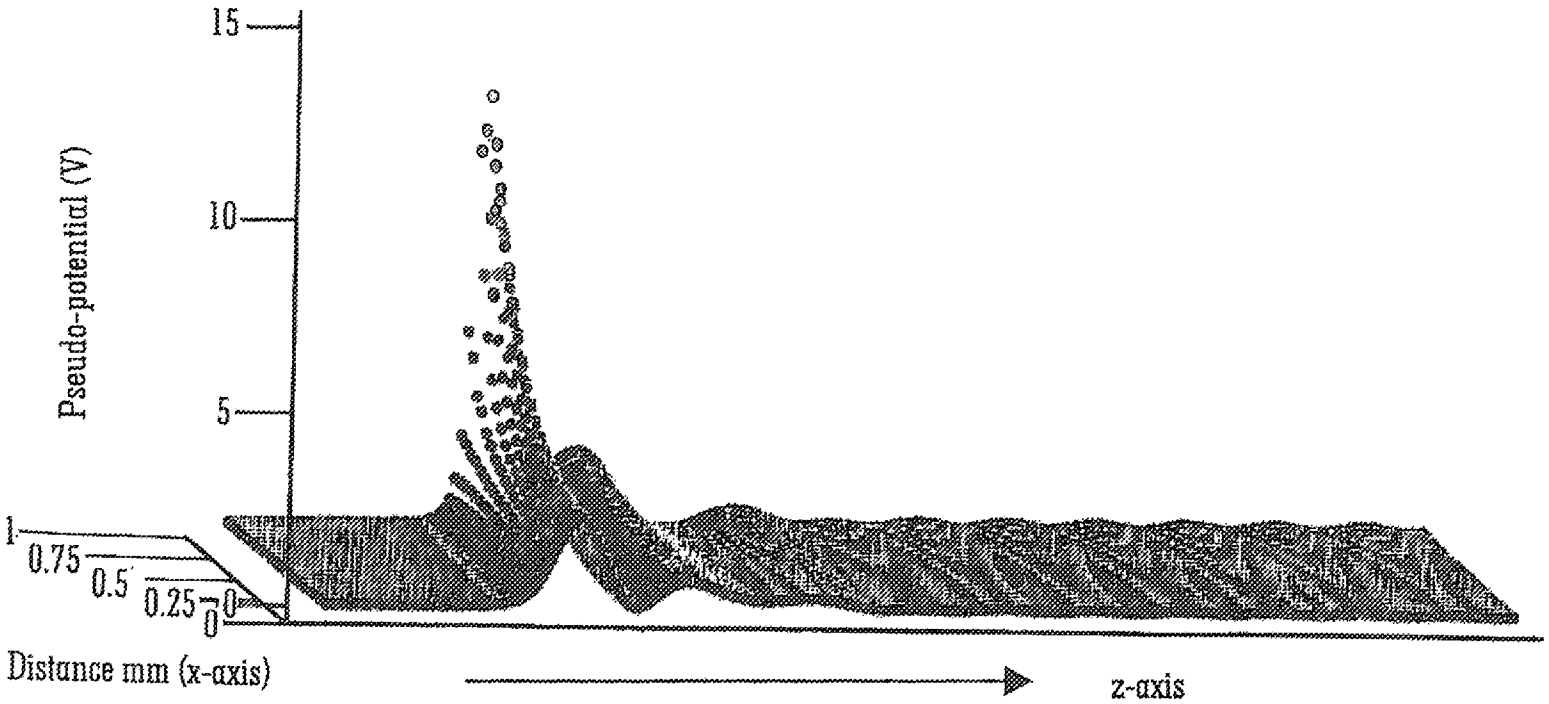
FIG. 14 shows a three-dimensional plot of the axial and radial pseudo-potential as shown in FIG. 13A as experienced by ions having a mass to charge ratio of 100.

FIG. 14 shows the form of the radial and axial pseudo-potential within the preferred ion guide or mass analyser 2 cut along the centre of the z-axis for a region at the entrance of the preferred ion guide or mass analyser 2 and extending from 0 to 0.1 mm in the x axis (radial direction). The conditions of voltage and frequency are as previously described, with reference to the embodiment described above with reference to FIG. 13.

The result of increasing the amplitude of the modulated potential at the entrance of the ion guide or mass analyser 2 is to produce a pseudo-potential barrier having an amplitude which is inversely proportional to the mass to charge ratio of ions. Ions with sufficient axial energy will overcome the pseudo-potential barrier and will be transmitted into the preferred ion guide or mass analyser 2 whilst ions with insufficient axial energy to overcome this barrier will be lost to the system.

According to an embodiment, the low mass to charge ratio transmission characteristic may be scanned, varied or stepped by changing the amplitude and/or the frequency of the modulated potential applied to the one or more first electrodes 15 arranged near or at the entrance of the preferred ion guide or mass analyser 2.

Figure 15:
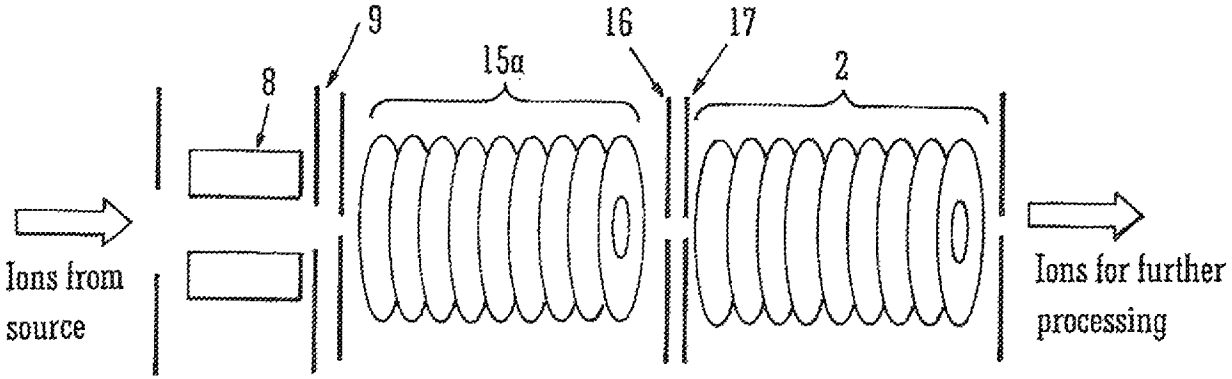
FIG. 15 shows an embodiment wherein an ion mobility separation device is coupled to a preferred ion guide or mass analyser.

According to another embodiment as shown in FIG. 15, a preferred ion guide or mass analyser 2 may be coupled to an ion mobility separator or spectrometer 15*a*. An ion guide or mass analyser 2 according to a preferred embodiment may be positioned, downstream of an ion mobility separator or spectrometer 15*a* and may be used to prevent, the onward transmission of ions having relatively low charge states whilst allowing the onward transmission of ions having relatively high charge states. If the ion mobility separator or spectrometer 15*a* is combined with a mass spectrometer or mass analyser, then the preferred ion guide or mass analyser 2 may be positioned downstream of the ion mobility separator or spectrometer 15*a* and upstream of the mass spectrometer or mass analyser. The preferred ion guide or mass analyser 2 may be used to prevent the onward transmission of ions having relatively low charge states whilst allowing the onward transmission of ions having relatively high charge states for subsequent mass analysis.

When used in combination with an ion mobility separator or spectrometer 15*a* the magnitude or height of a pseudo-potential barrier provided in a region of the preferred ion guide or mass analyser 2 and hence the low mass to charge ratio cut-off characteristic of the ion guide or mass analyser 2 may be scanned in synchronism with the pulsing of ions into the ion mobility separator or spectrometer 15*a* or the emergence of ions from the ion mobility separator or spectrometer 15*a*. Ions emerging from the ion mobility separator or spectrometer 15*a* at a pre-defined drift time and having a mass or mass to charge ratio below a pre-defined level may be excluded or prevented from transmission through the preferred ion guide or mass analyser 2. An important application of this embodiment is in the discrimination between ions having the same mass to charge ratio but having different charge states.

With reference to FIG. 15, ions from an ion source are preferably accumulated in an ion trap 8. The ions may be periodically released from the ion trap 8 by pulsing a gate electrode 9 arranged at an exit of the ion trap 8. The ions may then be pulsed into the ion mobility separator or spectrometer 15*a*. The ions then preferably travel through the ion mobility separator or spectrometer 15*a*. The ions are then preferably temporally separated according to their ion mobility as they transit through the ion mobility separator or spectrometer 15*a*. Ions having a relatively high ion mobility will preferably exit the Ion mobility separator or spectrometer 15*a* before ions having a relatively low ion mobility.

As ions exit the ion mobility separator or spectrometer 15*a* they are preferably accelerated by maintaining a DC potential difference between the exit electrode 16 of the ion mobility separator or spectrometer 15*a* and the entrance electrode 17 to the preferred ion guide or mass analyser 2. Ions entering the preferred ion guide or mass analyser 2 will preferably experience a pseudo-potential barrier which preferably has an amplitude which is preferably dependent upon the mass to charge ratio of ions. Ions having a relatively low mass to charge ratio will preferably experience a pseudo-potential barrier having a relatively high amplitude whereas ions having a relatively high mass to charge ratio will preferably experience a pseudo-potential barrier having a relatively low amplitude. Accordingly, ions below a certain mass to charge ratio will preferably not be transmitted into the preferred ion guide or mass analyser 2. Ions which are onwardly transmitted from the preferred ion guide or mass analyser 2 are preferably further processed as required. For example, ions may be transmitted to a mass spectrometer for subsequent mass analysis. Ions prevented from entering the preferred ion guide or mass analyser 2 are preferably lost to the system.

Figure 16:
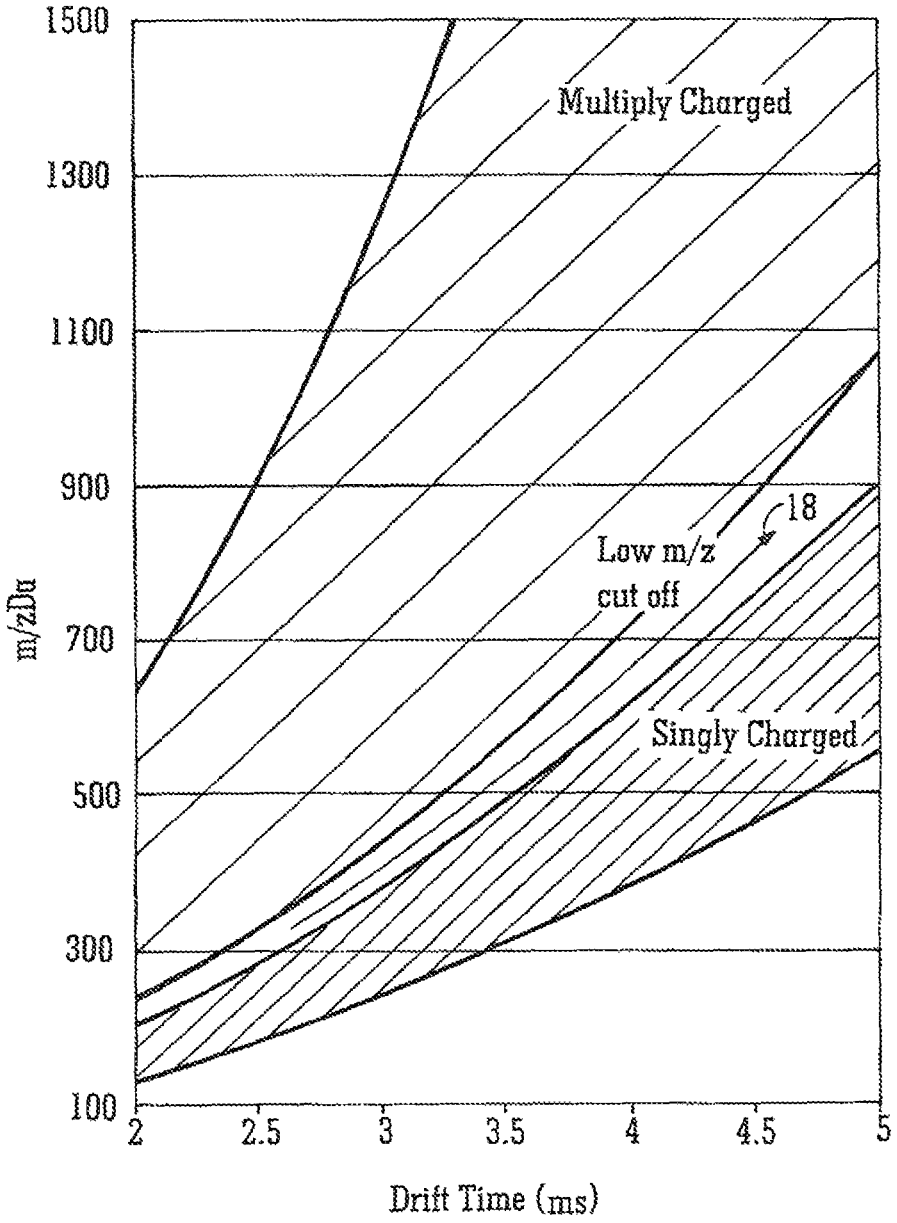
FIG. 16 shows a plot of the mass to charge ratio of ions as a function of drift time through an ion mobility device showing a scan line for low mass cut-off operation.

The magnitude of the pseudo-potential barrier provided within or at the entrance to the preferred ion guide or mass analyser 2 may be progressively increased during an ion mobility separation. FIG. 16 shows a plot of mass to charge ratio value as a function of ion mobility drift time. It can be seen that singly charged ions and multiply charged ions separate into two discrete bands. At any given drift time singly charged ions exiting the ion mobility separator or spectrometer 15*a* will have a lower mass to charge ratio than multiply charged ions exiting the ion mobility separator or spectrometer 15*a* at the same time. Accordingly, if the height of the pseudo-potential barrier at the entrance to the preferred ion guide or mass analyser 2 is arranged to be scanned with drift time such that ions with a mass to charge ratio value less than that indicated by line 18 shown in FIG. 16 are excluded, then predominantly only multiply charged ions will enter the preferred ion guide or mass analyser 2. Singly charged ions will preferably be lost. This has the advantageous result of significantly improving the signal to noise for the subsequent detection of multiply charged ions.

The ion mobility separator or spectrometer 15*a* may comprise a drift tube wherein an axial electric field is applied or maintained along the length of the drift tube. The ion mobility separator or spectrometer 15*a* may alternatively comprise an ion guide comprising a plurality of electrodes having apertures wherein one or more transient DC voltages or potentials or one or more DC voltage or potential waveforms are applied to the electrodes of the ion mobility separator or spectrometer. An AC or RF voltage may be applied to the electrodes to confine ions to the central axis thereby maximising transmission. The preferred operating pressure for the ion mobility separator or spectrometer 15*a* is preferably in the range $10^{-2}$ mbar to 10*s* mbar, more preferably $10^{-1}$ mbar to $10^{1}$ mbar.

Groups of ions which have been separated according to their ion mobility are preferably transmitted through the preferred ion guide or mass analyser 2 without loss of separation by applying one or more transient DC voltages or potentials or one or more transient DC voltage or potential waveforms to the electrodes comprising the ion guide or mass analyser 2. This is particularly advantageous as the preferred ion guide or mass analyser 2 is also coupled to an orthogonal acceleration Time of Flight mass analyser. The duty cycle may be improved by synchronising the orthogonal sampling pulse of the mass analyser with the arrival of ions at the orthogonal acceleration electrode.

Other embodiments are contemplated wherein multiple pseudo-potential barriers may be generated or created within or along the length of the preferred ion guide or mass analyser 2. This enables ion populations trapped within the preferred ion guide or mass analyser 2 to be manipulated in more complex ways. For example, the low mass to charge ratio cut-off characteristic of a first device or region used during filling of the preferred ion guide or mass analyser 2 may foe combined with a different higher low mass to charge ratio cut-off characteristic of a second device or region used to allow ejection of ions at the exit of the preferred ion guide or mass analyser 2. This enables ions to be trapped within the preferred ion guide or mass analyser 2 with mass to charge ratio values between the two cut-off values.

Figure 17:
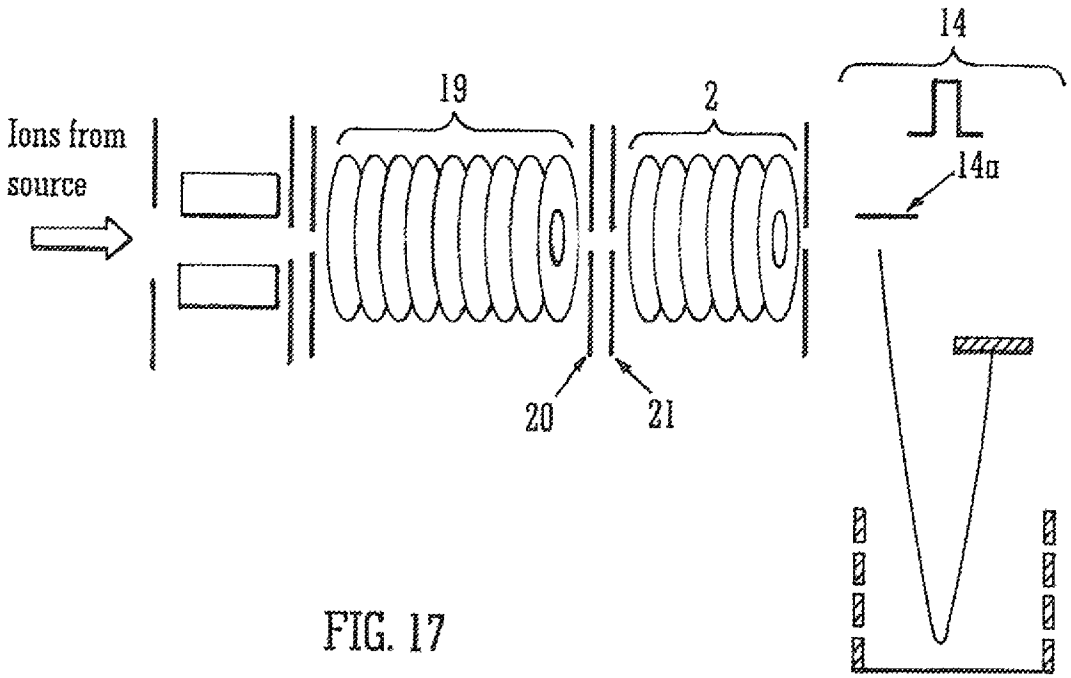
FIG. 17 shows an experimental arrangement which was used to produce experimental data as shown in FIGS. 18A-18E.

FIG. 17 shows an experimental arrangement wherein a preferred ion guide or mass analyser 2 was coupled to an orthogonal acceleration Time of Flight mass analyser 14. A continuous beam of ions was introduced from an Electrospray ionisation source. The ions were arranged to pass through a first stacked ring ion guide 19 maintained at a pressure of approximately $10^{-1}$ mbar Argon. A transient DC potential having an amplitude of 2 V was applied to and progressively translated along the length of the ion guide 19 in order to urge ions through and along the ion guide 19. Ions preferably exit the ion guide 19 via an aperture in a DC only exit plate 20 and enter a preferred stacked ring ion guide or mass analyser 2 maintained at a pressure of: approximately $10^{-2}$ mbar Argon via an entrance electrode 21. The potential difference between the exit place 20 of the ion guide 19 and the entrance plate 21 of the preferred ion guide or mass analyser 2 was maintained at −2 V. On exiting the preferred ion guide or mass analyser 2 ions pass through a transfer region and are then mass analysed by an orthogonal acceleration Time of Flight mass analyser 14. The ion guide 19 and the preferred ion guide or mass analyser 2 were both supplied with an RF voltage of 200 V pk-pk at a frequency of 2 MHz in order to confine ions radially within the upstream ion guide 19 and the preferred ion guide or mass analyser 2.

In addition to the application of a DC voltage, the entrance plate 21 to the preferred ion guide or mass analyser 2 was coupled to an independent RF supply having an independently variable amplitude. The RF supply had a frequency of 750 MHz. During the experiment the amplitude of the modulated potential applied to the entrance plate 21 was increased from 0 V to 550 V pk-pk.

FIGS. 18A-18E show mass spectra which were obtained by a continuous infusion of a mixture of standard compounds including polyethylene glycol having an average molecular mass 1000 and Triacetyl-cyclodextrin wherein $[M+H]^{+}$= 2034.6.

Figure 18A:
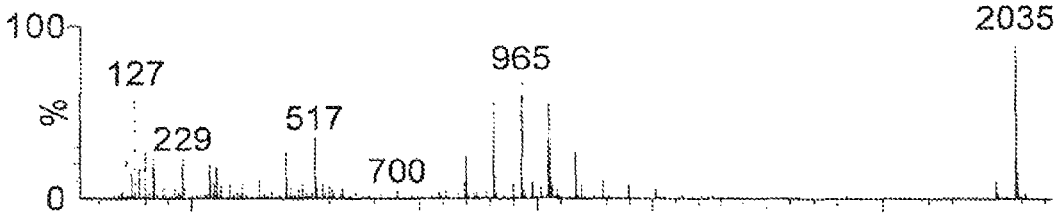
FIG. 18A shows a mass spectrum obtained in the absence of an axial pseudo-potential barrier.
Figure 18B:
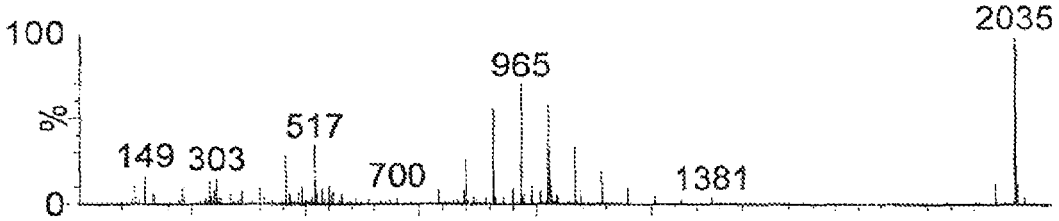
FIG. 18B shows a mass spectrum obtained when an axial pseudo-potential barrier was provided at the entrance to a preferred ion guide or mass analyser as shown in FIG. 17.
Figure 18C:
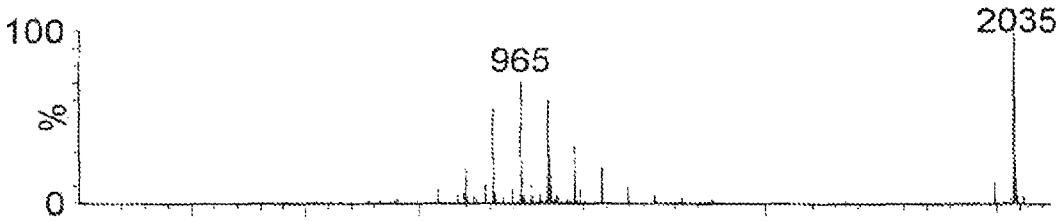
FIG. 18C shows a resulting mass spectrum obtained when the axial pseudo-potential barrier had a magnitude which was greater than that used to obtain the results shown in FIG. 18B.
Figure 18D:
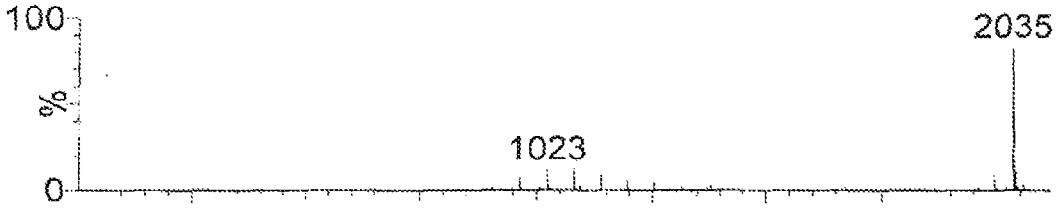
FIG. 18D shows a mass spectrum obtained when the axial pseudo-potential barrier had a magnitude which was greater than, that used to obtain the results shown in FIG. 18C

FIG. 18A shows a mass spectrum recorded wherein the amplitude of the RF voltage applied to the entrance plate 21 was 0 V. FIGS. 18B-18E show resulting mass spectra which were obtained as the amplitude of the RF voltage applied to the entrance plate 21 was manually increased from 0 V to a maximum of 550 V pk-pk. The mass spectrum shown in FIG. 18E was obtained when the RF voltage was set at a maximum of 550 V pk-pk. For all the mass spectra the intensity was normalised to the same value to allow direct comparison.

Figure 18E:
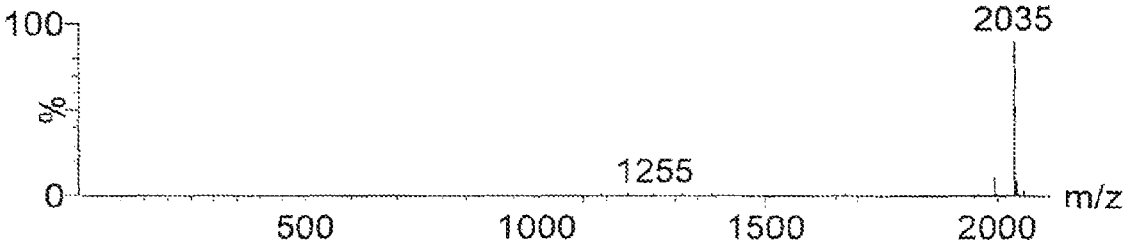
FIG. 18E shows a mass spectrum obtained when the axial pseudo-potential barrier had a magnitude which was greater than that used to obtain the results shown in FIG. 18D.

It can be seen from FIGS. 18A-18E that as the amplitude of the RF voltage applied to the entrance plate 21 was increased progressively then low mass to charge ratio ions are increasingly prevented from entering the preferred ion guide or mass analyser 2 and hence do not appear in the mass spectra. When the maximum RF amplitude of 550 V pk-pk was applied as shown in FIG. 18E, then the majority of ions having mass to charge ratios <1800 can be seen to have been, removed without there being any attenuation of peaks corresponding to ions having higher mass to charge ratios.

Applying the RF potential to the entrance plate 21 produces a mass dependent barrier which increases in magnitude as the amplitude of the RF is increased. At a particular RF amplitude ions below a certain mass to charge ratio cannot overcome this pseudo-potential barrier and hence are prevented from entering the preferred ion guide or mass analyser 2.

If the frequency of the AC potential applied to elements of the preferred ion guide or mass analyser 2 which are; in close proximity is different, then there may be some interaction between the modulated potential forming the mass selective barrier and the modulated potential used for radial confinement of ions within the preferred ion guide or mass analyser 2. This interaction may lead to instability of ions within these regions of the ion guide or mass analyser 2. In cases where this interaction is undesirable, regions of different AC potential may be separated or shielded by electrodes supplied by DC potentials rather than AC potentials.

According to the preferred embodiment ions are preferably pulsed into the preferred ion guide or mass analyser 2 using a gate electrode. However, alternative embodiments are contemplated wherein, for example, a pulsed ion source such as MALDI ion source may be used and wherein time $T_0$ corresponds to the firing of the laser.

According to an embodiment a fragmentation region or device may be provided after or downstream of the mass separation region. The potential difference between the preferred ion guide or mass analyser 2 and the fragmentation region or device may be ramped down as the amplitude of the one or more transient DC voltages or potentials or the one or mores transient DC voltage or potential waveforms is preferably ramped up. The preferred ion guide or mass analyser 2 may then be optimised for fragmenting a desired mass to charge ratio range of ions at a given time.

According to the preferred embodiment an electric field, preferably in the form of one or more transient DC voltages or potentials or one or more transient DC voltage or potential waveforms is preferably used to drive ions over or across a pseudo-potential barrier. According to other embodiments ions may be driven across a pseudo-potential barrier by means of the viscous drag caused by a flow of gas. The viscous drag due to gas flow will become significant for gas pressures greater than $10^{-2}$ mbar, preferably greater than $10^{-1}$ mbar. The viscous drag due to gas flew may also be combined with the force due to an electric field, such as that derived from one or more transient DC voltages or potentials or one or more transient DC voltage or potential waveforms. The forces on an ion due to viscous drag and due to an electric field may be arranged to work in unison or alternatively may be arranged to oppose each other.

Although the present invention has been described with reference to preferred embodiments, it will be understood by those skilled in the art that various changes in form and detail may be made to the particular embodiments discussed above without departing from the scope of the invention as set forth in the accompanying claims.

The invention claimed is:

1. A mass analyser comprising:

an ion guide having a plurality of electrodes;

an RF voltage supply for applying first RF voltages to one or more of the electrodes such that, in use, a first axial pseudo-potential barrier or well is created along at least a portion of the axial length of said ion guide; and a DC voltage supply for applying one or more DC voltages to the electrodes of the ion guide such that, in use, ions are urged through the ion guide and ions having a first range of mass to charge ratios are urged passed the barrier or well, whereas ions having a second, different range of mass to charge ratios are unable to pass the barrier or well.

2. The mass analyser of claim 1, wherein the RF voltage supply is configured such that, in use, the RF voltages applied to the one or more electrodes are varied with time so that an amplitude of the potential barrier or well varies with time so that ions of different mass to charge ratios are able to be urged passed the potential barrier or well by the DC voltages at different times.

3. The mass analyser of claim 2, wherein ions having a first range of mass to charge ratios are urged passed the potential barrier or well at a first time and ions having a second, lower range of mass to charge ratios are urged passed the potential barrier or well at a second, later time.

4. The mass analyser of claim 2, wherein the amplitude of the potential barrier or well is decreased with time such that ions of progressively lower mass to charge ratios are able to be urged passed the potential barrier or well by the one or more DC voltages as time progresses.

5. The mass analyser as claimed in claim 2, wherein the RF voltage supply is arranged and adapted to progressively increase, progressively decrease, progressively vary, scan, linearly increase, linearly decrease, increase in a stepped manner or decrease in a stepped manner the amplitude or frequency of the RF voltages applied to one or more of said plurality of electrodes.

6. The mass analyser of claim 1, wherein the DC voltage supply is arranged to apply voltages to the electrodes such that, in use, one or more DC voltage travels along the ion guide and urges ions along the ion guide.

7. The mass analyser of claim 1, wherein the mass analyser is configured so that the ions that are urged passed the potential barrier or well exit the ion guide and the ions that are unable to pass the potential barrier or well are trapped within the ion guide.

8. The mass analyser of claim 1, wherein the RF voltage supply is configured to apply RF voltages to one or more of the electrodes such that, in use, a plurality of axial pseudo-potential barriers or wells are created along at least a portion of the axial length of said ion guide, and wherein the DC voltage supply is configured to apply DC voltages to the electrodes of the ion guide such that, in use, ions are urged through the ion guide and wherein ions having a first range of mass to charge ratios are urged passed the plurality of axial barriers or wells, whereas ions having a second, different range of mass to charge ratios are unable to pass the axial barriers or wells.

9. The mass analyser of claim 1, comprising a voltage source for applying a second RF voltage to at least some of the plurality of electrodes such that, in use, one or more second axial pseudo-potential barriers or wells having an amplitude different to the amplitude of the first barrier or well are created along at least a portion of the axial length of said ion guide.

10. The mass analyser of claim 1, comprising one or more electrodes arranged at the entrance or exit of said ion guide and wherein, in use, said one or more electrodes are arranged to pulse ions into or out of said ion guide.

11. The mass analyser of claim 1, wherein the mass analyser is incorporated as part of a mass spectrometer.

12. A method of mass analysing ions with an ion guide having a plurality of electrodes, said method comprising:

applying first RF voltages to one or more of the electrodes such that a first axial pseudo-potential barrier or well is created along at least a portion of the axial length of said ion guide; and applying one or more DC voltages to the electrodes of the ion guide such that ions are urged through the ion guide and so that ions having a first range of mass to charge ratios are urged passed the barrier or well, whereas ions having a second, different range of mass to charge ratios are unable to pass the barrier or well.

13. The method of claim 12, wherein the RF voltages applied to the one or more electrodes are varied with time so that an amplitude of the potential barrier or well varies with time so that ions of different mass to charge ratios are able to be urged passed the potential barrier or well at different times.

14. The method of claim 12, wherein ions having mass to charge ratios in a first range are urged passed the potential barrier or well at a first time and ions having mass to charge ratios in a second, lower range are urged passed the potential barrier or well by the one or more DC voltages at a second, later time.

15. The method of claim 12, wherein the amplitude of the potential barrier or well is decreased with time such that ions of progressively lower mass to charge ratios are able to be urged passed the potential barrier or well by the one or more DC voltages as time progresses.

16. The method of claim 12, further comprising progressively increasing, progressively decreasing, progressively varying, scanning, linearly increasing, linearly decreasing, increasing in a stepped manner or decreasing in a stepped manner the amplitude or frequency of the RF voltage applied to one or more of said plurality of electrodes.

17. The method of claim 12, wherein said step of applying DC voltages comprises applying DC voltages to the electrodes such that one or more DC voltage travels along the ion guide and urges ions along the ion guide.

18. The method of claim 12, further comprising:

causing the ions that are urged passed the potential barrier or well to exit the ion guide; and trapping the ions that are unable to pass the potential barrier or well within the ion guide.

19. The method of claim 12, comprising applying second RF voltages to at least some of the plurality of electrodes such that one or more second axial pseudo-potential barriers or wells having an amplitude different to the amplitude of the first barrier or well are created along at least a portion of the axial length of said ion guide.

* * * * *